US008547297B1

(12) United States Patent
Hoppenstein et al.

(10) Patent No.: US 8,547,297 B1
(45) Date of Patent: Oct. 1, 2013

(54) ENHANCED COLOR RESOLUTION DISPLAY SCREEN USING PIXEL SHIFTING

(75) Inventors: Reuben Hoppenstein, New Rochelle, NY (US); Eric Rosenthal, Morganville, NJ (US)

(73) Assignee: 3-D Virtual Lens Technologies, LLC, New York, NY (US)

( * ) Notice: Subject to any disclaimer, the term of this patent is extended or adjusted under 35 U.S.C. 154(b) by 0 days.

(21) Appl. No.: 13/541,640

(22) Filed: Jul. 3, 2012

Related U.S. Application Data

(60) Provisional application No. 61/571,811, filed on Jul. 5, 2011, provisional application No. 61/571,812, filed on Jul. 5, 2011, provisional application No. 61/571,813, filed on Jul. 5, 2011, provisional application No. 61/571,815, filed on Jul. 5, 2011, provisional application No. 61/571,814, filed on Jul. 5, 2011.

(51) Int. Cl.
*G09G 5/00* (2006.01)

(52) U.S. Cl.
USPC ..... 345/4; 345/589; 345/697; 345/698; 345/3.3; 345/38; 345/55; 349/62; 349/64; 349/80; 349/106; 349/109

(58) Field of Classification Search
None
See application file for complete search history.

(56) References Cited

U.S. PATENT DOCUMENTS

| | | | | |
|---|---|---|---|---|
| 1,128,979 | A | 2/1916 | Hess | |
| 4,448,490 | A | 5/1984 | Shibuya et al. | |
| 5,124,818 | A | 6/1992 | Conner et al. | |
| 5,184,234 | A * | 2/1993 | Mathewson | 349/5 |
| 5,315,377 | A | 5/1994 | Isono et al. | |
| 5,689,283 | A | 11/1997 | Shirochi | |
| 5,825,541 | A | 10/1998 | Imai | |
| 5,838,494 | A | 11/1998 | Araki | |
| 6,040,807 | A | 3/2000 | Hamagishi et al. | |
| 6,061,424 | A | 5/2000 | Hoppenstein et al. | |
| 6,195,205 | B1 | 2/2001 | Faris | |
| 6,421,174 | B1 | 7/2002 | Ooshiman et al. | |

(Continued)

FOREIGN PATENT DOCUMENTS

JP 2000-098966 7/2000

OTHER PUBLICATIONS

Berthier, A. Images Stereoscopiques de Grand Format. Cosmos (34): 205-210 (1896) ; original and machine translation submitted herewith.

(Continued)

*Primary Examiner* — Antonio A Caschera
(74) *Attorney, Agent, or Firm* — McCarter & English, LLP; David R. Burns

(57) ABSTRACT

In an exemplary embodiment, the color resolution of a first image display screen is increased by assembling the first display screen with a second image display screen in an overlaid manner. Transmissive color filter elements are provided associated with addressable sub-pixels of the display screens. A first set of sub-pixels of the first screen and a second set of sub-pixels of the second screen are cooperatively addressed to display an image pixel of the display assembly, where the first set of sub-pixels addressed is spatially offset from the second set of sub-pixels addressed along the planar surfaces of the display screens. The exemplary display assembly formed by the display screens thereby enables the use of more than three colors to define a broadened color space relative to that defined by the display screens separately.

9 Claims, 25 Drawing Sheets

(56) References Cited

U.S. PATENT DOCUMENTS

| | | | | |
|---|---|---|---|---|
| 6,690,346 | B1 | 2/2004 | Hanano | |
| 7,324,276 | B2 | 1/2008 | Wood | |
| 7,404,642 | B2 | 7/2008 | Shestak et al. | |
| 7,513,623 | B2 | 4/2009 | Thomas | |
| 7,679,616 | B2 | 3/2010 | Nomura et al. | |
| 7,715,618 | B2 | 5/2010 | Shioi et al. | |
| 7,874,678 | B2 | 1/2011 | Hines | |
| 8,038,316 | B2 * | 10/2011 | Silverstein et al. | 362/231 |
| 2002/0118452 | A1 | 8/2002 | Taniguchi et al. | |
| 2004/0012851 | A1 | 1/2004 | Sato et al. | |
| 2005/0225563 | A1 * | 10/2005 | Brown Elliott et al. | 345/604 |
| 2006/0256302 | A1 | 11/2006 | Hsu | |
| 2007/0146876 | A1 | 6/2007 | Peterson et al. | |
| 2008/0024598 | A1 | 1/2008 | Perlin et al. | |
| 2008/0068329 | A1 | 3/2008 | Shestak et al. | |

OTHER PUBLICATIONS

Cie. Commission internationale de l'Eclairage proceedings, 1931. Cambridge University Press, Cambridge. (1932).

Hecht, J. 3-D TV and Movies: Exploring the Hangover Effect. Optics & Photonics News. 20-27 (2011).

ITU-R BT.709-5: Parameter values for the HDTV standards for production and international programme exchange. Apr. 2002.

Ives, FE. A Novel Stereogram. Journal of The Franklin Institute. 153:51-52 (1902).

Wheatstone, C. Contributions to the Physiology of Vision. Part the First. On Some Remarkable, and Hitherto Unobserved, Phenomena of Binocular Vision. Phil. Trans. R. Soc. Lond. 128:371-394 (1838).

* cited by examiner

Display Panel 1
2001

Display Panel 2
2002

Combined Display Panels
2060

ENHANCED COLOR RESOLUTION DISPLAY SCREEN USING PIXEL SHIFTING

CROSS-REFERENCE TO RELATED APPLICATIONS

This application is a non-provisional of and claims priority to U.S. Provisional Application Ser. No. 61/571,811, filed Jul. 5, 2011; U.S. Provisional Application Ser. No. 61/571,812, filed Jul. 5, 2011; U.S. Provisional Application Ser. No. 61/571,813, filed Jul. 5, 2011; U.S. Provisional Application Ser. No. 61/571,814, filed Jul. 5, 2011; and U.S. Provisional Application Ser. No. 61/571,815, filed Jul. 5, 2011. The entire contents of each of the above-referenced applications are incorporated herein by reference in their entirety.

BACKGROUND

Liquid crystal device (LCD) technology is the basis for many display applications including, but not limited to, mobile phones, PDAs, tablet computers, notebook computers, computer monitors, medical monitors, advertising displays, and televisions of up to, currently, almost 3-m diagonal dimension. High-definition television (HDTV) is now pervasive, with spatial resolutions of up to 1920×1080 pixels in progressive mode (1080p).

A common representation of color space is the two-dimensional diagram created by Commission Internationale de l'Eclairage (CIE) in 1931 (Commission Internationale de l'Eclairage Proceedings, 1931). FIG. 1 illustrates a CIE 1931 color space chromaticity diagram plotting the y chromaticity coordinate along the y-axis and the x-axis coordinate along the x-axis. In FIG. 1, the gamut of all colors visible to humans is represented within the interior of the solid-line 101. As an example of currently realizable colors, the inscribed triangle 102 in FIG. 1 shows the gamut of Rec. 709 (ITU-R BT.709-5: Parameter values for the HDTV standards for production and international programme exchange, April, 2002), which is the color recommendation for HDTV.

SUMMARY

Exemplary embodiments increase the color resolution of image display screens by assembling a first image display screen with a second image display screen in an overlaid manner so that their planar surfaces are co-planar. Transmissive color filter elements are provided associated with addressable sub-pixels of the display screens. A first set of sub-pixels of the first screen and a second set of sub-pixels of the second screen are cooperatively addressed to display an image pixel of the display assembly, where the first set of sub-pixels addressed is spatially offset from the second set of sub-pixels addressed in the vertical direction and/or the horizontal direction along the planar surfaces of the display screens. The exemplary display assembly formed by the display screens thereby enables the use of more than three colors to define a broadened color space relative to that defined by the display screens separately. The color resolution of the display assembly formed by the first and second display screens is higher than the individual color resolutions of the display screens.

In accordance with one exemplary embodiment, a method is provided for achieving an enhanced color resolution in an image display assembly. The method includes addressing a first set of addressable sub-pixels on a first display screen, the first set of sub-pixels associated with a first set of color filter elements. The addressing of the first set of sub-pixels generates filtered optical output from the first set of sub-pixels through the first set of color filter elements. The method also includes addressing a second set of addressable sub-pixels on a second image display screen, the second set of sub-pixels associated with a second set of color filter elements. The addressing of the second set of sub-pixels generates filtered optical output from the second set of sub-pixels through the second set of color filter elements. The first and second display screens are assembled in an overlaid manner. The first set of sub-pixels addressed is spatially offset from the second set of sub-pixels addressed in a vertical direction and/or a horizontal direction along planar surfaces of the first and second display screens. The cooperative addressing of the first and second sets of sub-pixels displays an image pixel with a color resolution greater than a first color resolution provided by the first display screen and a second color resolution provided by the second display screen.

In accordance with another exemplary embodiment, a method is provided for fabricating an image display assembly for providing enhanced color resolution. The method includes assembling a first display screen having a first color resolution and including a first set of addressable sub-pixels in an overlaid manner with a second display screen having a second color resolution and including a second set of addressable sub-pixels. The method includes aligning a first set of color filter elements associated with the first set of sub-pixels of the first display screen. The method includes aligning a second set of color filter elements associated with the second set of sub-pixels of the second display screen. The method also includes providing a processing device configurable to address the first set of sub-pixels of the first display screen to generate filtered optical output from the first set of sub-pixels through the first set of color filter elements, and to address the second set of sub-pixels of the second display screen to generate filtered optical output from the second set of sub-pixels through the second set of color filter elements. The first set of sub-pixels addressed is spatially offset from the second set of sub-pixels addressed in a vertical direction and/or a horizontal direction along planar surfaces of the first and second display screens. The cooperative addressing of the first and second sets of sub-pixels displays an image pixel with a color resolution greater than the first color resolution provided by the first display screen and the second color resolution provided by the second display screen.

In accordance with another exemplary embodiment, an image display assembly is provided for achieving enhanced color resolution. The image display assembly includes a first display screen comprising a first set of addressable sub-pixels, the first display screen having a first color resolution. The image display assembly includes a second display screen comprising a second set of addressable sub-pixels assembled with the first display screen in an overlaid manner, the second display screen having a second color resolution. The image display assembly includes a first set of color filter elements associated with the first set of addressable sub-pixels of the first display screen, and a second set of color filter elements associated with the second set of addressable sub-pixels of the second display screen. The image display assembly also includes a processing device configurable to address the first set of sub-pixels of the first display screen to generate filtered optical output from the first set of sub-pixels through the first set of color filter elements, and to address the second set of sub-pixels of the second display screen to generate filtered optical output from the second set of sub-pixels through the second set of color filter elements. The first set of sub-pixels addressed is spatially offset from the second set of sub-pixels addressed in a vertical direction and/or a horizontal direction along planar surfaces of the first and second display screens. The cooperative addressing of the first and second sets of sub-pixels displays an image pixel with a color resolution greater than the first color resolution provided by the first display screen and the second color resolution provided by the second display screen.

BRIEF DESCRIPTION OF THE DRAWINGS

The foregoing and other objects, aspects, features, and advantages of exemplary embodiments will become more apparent and may be better understood by referring to the following description taken in conjunction with the accompanying drawings, in which.

DETAILED DESCRIPTION

Figure 1:
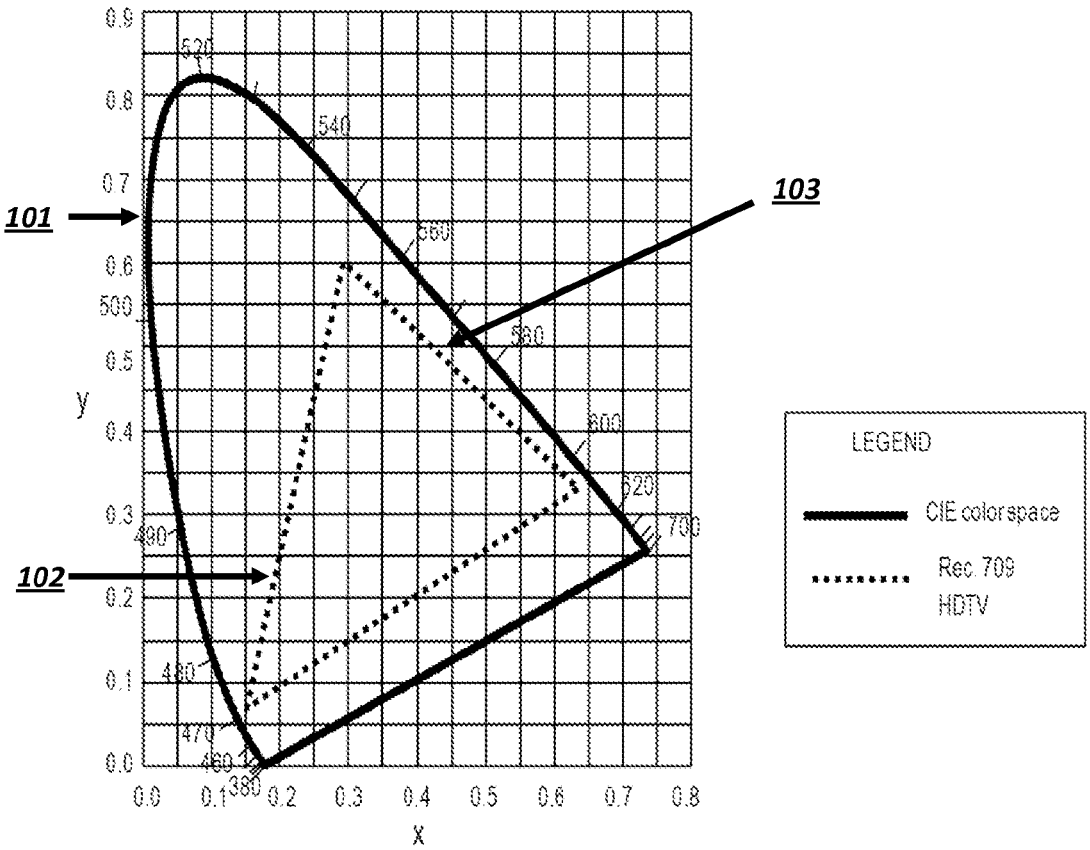
FIG. 1 is the CIE 1931 color space chromaticity diagram, showing the triangular color space of ITU-Recommendation BT.709 (commonly known as Rec. 709) for HDTV.

While substantial efforts have been made to increase the size and spatial resolution of conventional image displays (e.g., HDTV), conventional display systems have limited color resolution. Recent improvements in color gamut have been announced in color televisions that include yellow (Y) in addition to standard RGB pixels. A conventional system named Sharp Aquos Quattron is an attempt to enlarge the available color gamut by incorporation of the color yellow, but this has only minimal effect on the color space outside the Rec. 709 triangle 102 (depicted in FIG. 1). The area between the color spaces defined by 101 and 102 in the yellow portion of the visible spectrum (roughly indicated at 103 in FIG. 1), between approximately 570 and 580 nm in wavelength, is small in the conventional Sharp Aquos Quattron system and does not provide a viewer with a substantially improved perception of color than does the color space of Rec. 709.

Exemplary embodiments provide color resolution improvements over conventional display systems by enabling the use of more than three colors to define a broadened color space. Exemplary embodiments include systems, devices and methods for increasing the color resolution of display screens. In an exemplary embodiment, the color resolution of a first image display screen is increased by assembling the first display screen with a second image display screen in an overlaid manner so that their planar surfaces are co-planar. Transmissive color filter elements are provided associated with addressable sub-pixels of the display screens. In an exemplary embodiment, a backlight provides light at all wavelengths that are transmitted by the color filter elements associated with the sub-pixels.

A first set of sub-pixels of the first screen and a second set of sub-pixels of the second screen are cooperatively addressed to display an image pixel of the display assembly, where the first set of sub-pixels addressed is spatially offset from the second set of sub-pixels addressed along the planar surfaces of the display screens in the horizontal direction, in the vertical direction or in both horizontal and vertical directions. In some exemplary embodiments, the spatial offset is exactly or approximately a fraction of a pixel width in the horizontal direction and/or exactly or approximately a fraction of a pixel height in the vertical direction. The exemplary display assembly formed by the display screens thereby enables the use of more than three colors to define a broadened color space relative to that defined by the display screens separately. The broadened color space may or may not be triangular in shape when plotted on the CIE 1931 coordinates. In some exemplary embodiments, each sub-pixel in the first set of sub-pixels is offset from each sub-pixel in the second set of sub-pixels in the vertical direction and/or the horizontal direction along the planar surfaces of the display screens.

The above exemplary embodiment of a display based on two display screens may be generalized to displays based on a greater number, m, of display screens. In such cases, all of the m display screens may be assembled in an overlaid manner so that their planar surfaces are co-planar to one another. The sub-pixels addressed by exemplary embodiments on one display screen may be spatially offset from the sub-pixels addressed on another display screen by exactly or approximately 1/mth of the dimension (height and/or width) of a full-color pixel. For example, for a display assembly including three display screens, the sub-pixels addressed on one display screen may be spatially offset from the sub-pixels addressed on the other two display screens by exactly or approximately $\frac{1}{3}^{rd}$ of the dimension (height and/or width) of a full-color pixel.

The terms "display screen," "display panel," "screen" and "panel," as used interchangeably herein, refer to any suitable device or device assembly for displaying two-dimensional and/or three-dimensional images in enhanced color resolution. In an exemplary display assembly including two display screens, a first display screen distal to an image viewer (e.g., disposed on the other side of a second display screen as the viewer) may be any type of two-dimensional array of either transmissive light-valves or emissive elements. Exemplary first display screens may include plasma, light-emitting diode (LED), organic light-emitting diode (OLED), field-emission devices, cathode ray tube (CRT), electro-luminescent, liquid crystal display (LCD), or other types of displays. Emissive displays used in this capacity may also provide the function of a backlight, and may obviate the need for a separate backlight in some exemplary embodiments. A second display screen proximal to an image viewer (i.e., disposed between the image viewer and the first display screen) may be any type of two-dimensional array of transmissive light-valves and is not restricted to liquid crystal technology. Exemplary second display screens may be based on liquid crystal distal technology, microelectromechanical systems (MEMS), electro-optical, acousto-optical, and other suitable technologies.

Figure 2:
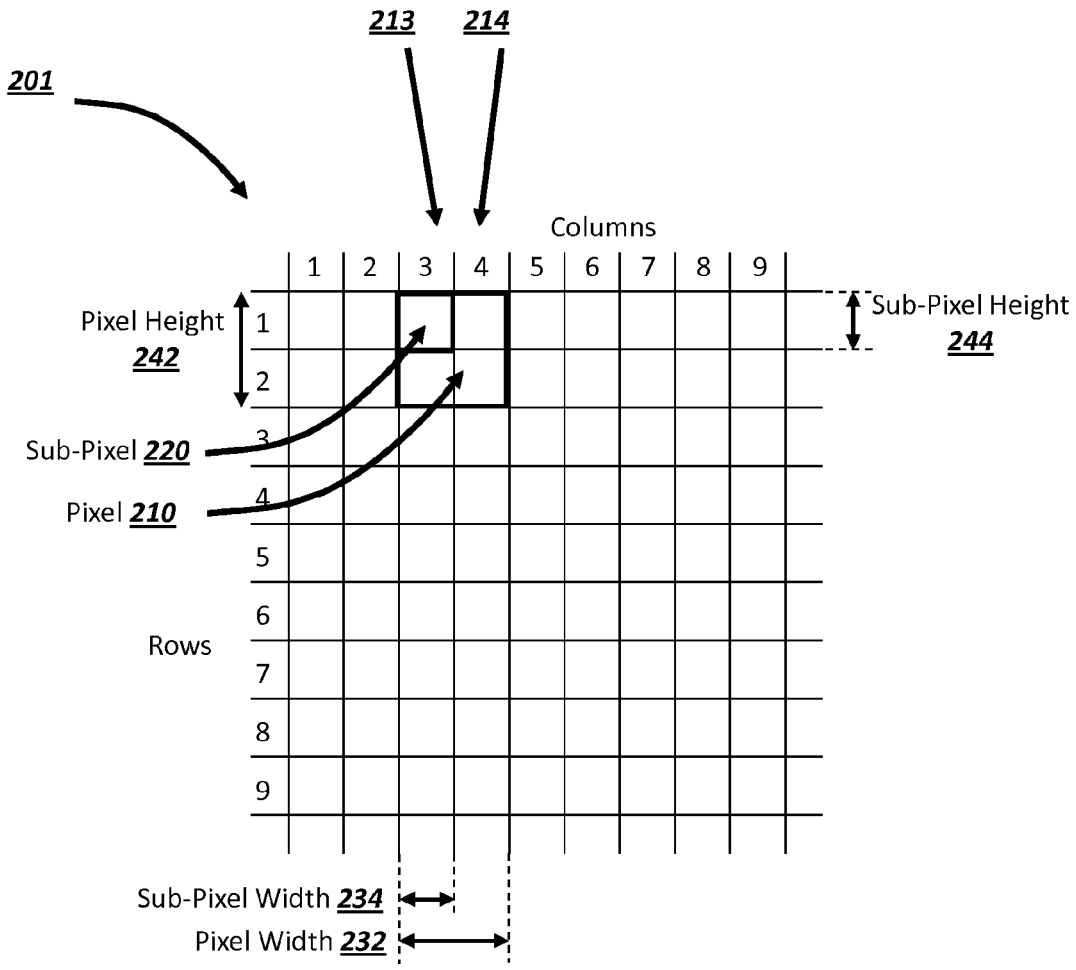
FIG. 2 shows a coordinate system of an exemplary display assembly including two display screens.

FIG. 2 shows an exemplary pixel coordinate system 201 of a display assembly upon which an enhanced color resolution display may be constructed in accordance with exemplary embodiments. In the example shown, a pixel 210 comprises two adjacent columns, e.g., 213 and 214, with odd numbered columns corresponding to sub-pixels on a first display screen (Display Panel 1) and even-numbered columns corresponding to sub-pixels on a second display screen (Display Panel 2). For certain display panels, the pixel 210 may include four sub-pixels in a 2×2 array. Sub-pixel 220 is an example of a sub-pixel on the first display screen. The pixel height 242 may comprise one, two, or more rows, depending on the number of different filter elements that are to be used for the embodiment chosen. As shown in FIG. 2, and as is common with many Bayer mask patterns, the sub-pixel width 234 and height 244 are respectively one-half the size of the pixel width 232 and height 242. Thus, a pixel in a display screen (e.g., Display Panel 1 and/or 2) may include four sub-pixels in some exemplary embodiments, and may be used to transmit red (R), green (G), green (G), and blue (B).

In exemplary embodiments, one or more different color filter elements may be used in association with addressable sub-pixel columns in each display screen. The color filter elements may be provided separately, on a single filter mask, or on a plurality of filter masks.

Figure 3:
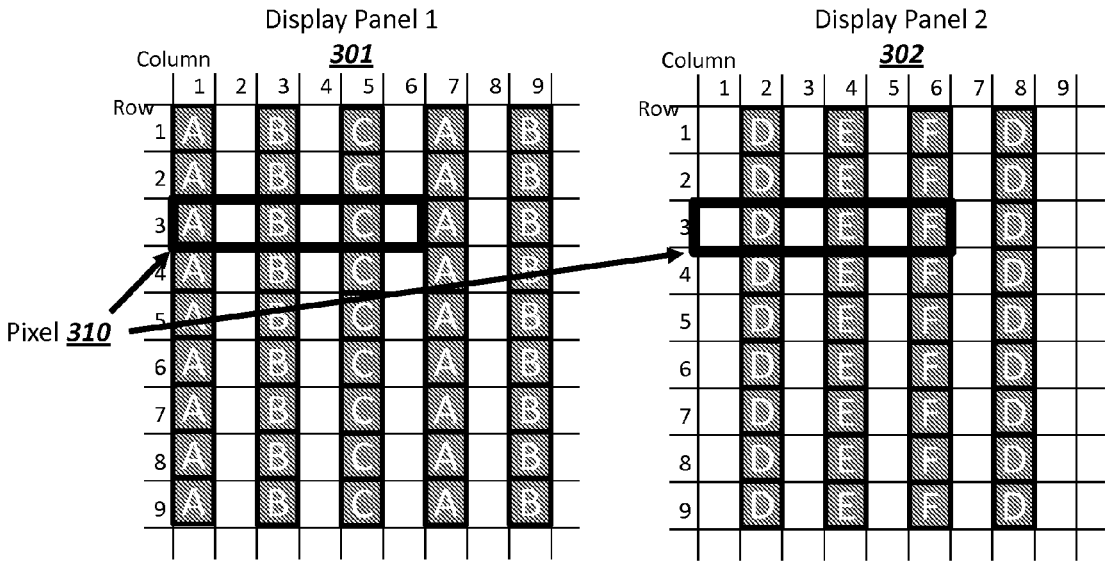
FIG. 3 depicts addressable sub-pixels of two display screens for an exemplary display assembly, showing their correspondence to associated color filter elements.

FIG. 3 is an embodiment in which six different filter elements may be used in the filter mask. In this case, the color filter elements are labeled A, B, C, D, E, and F, and each represents any suitable point in the interior of the CIE-contour 101 of FIG. 1. These letters are chosen to reinforce the concept that any color be selected and that the colors need not be restricted to conventional colors such as red, green, and blue.

In this exemplary embodiment, Display Panel 1 301 includes an array of sub-pixels that transmit light, in varying amounts according to the twist imparted to the liquid crystal molecules of each sub-pixel. The sub-pixel array of exemplary Display Panel 1 301 includes alternating columns of sub-pixels (e.g., columns 1, 3, 5, 7, 9) that may be addressed during image display by exemplary embodiments. The columns of sub-pixels (i.e., columns 1, 3, 5, 7, 9) are associated with three exemplary color filter elements—A, B, or C—of a filter mask. The filter mask is associated with Display Panel 1 301 such that sub-pixel column 1 is associated with color filter A, column 3 is associated with color filter B, column 5 is associated with color filter C, column 7 is associated with color filter A, and column 9 is associated with color filter B, and the like.

Display Panel 2 302 includes an array of sub-pixels that transmit light, in varying amounts according to the twist imparted to the liquid crystal molecules of each sub-pixel. The sub-pixel array of exemplary Display Panel 2 302 includes alternating columns of sub-pixels (e.g., columns 2, 4, 6, 8) that may be addressed during image display by exemplary embodiments. The columns of sub-pixels (i.e., columns 2, 4, 6, 8) are associated with three exemplary color filter elements—D, E, or F—of the filter mask. The filter mask is associated with Display Panel 2 302 such that sub-pixel column 2 is associated with color filter D, column 4 is associated with color filter E, column 6 is associated with color filter F, column 8 is associated with color filter D, and the like.

Figure 4:
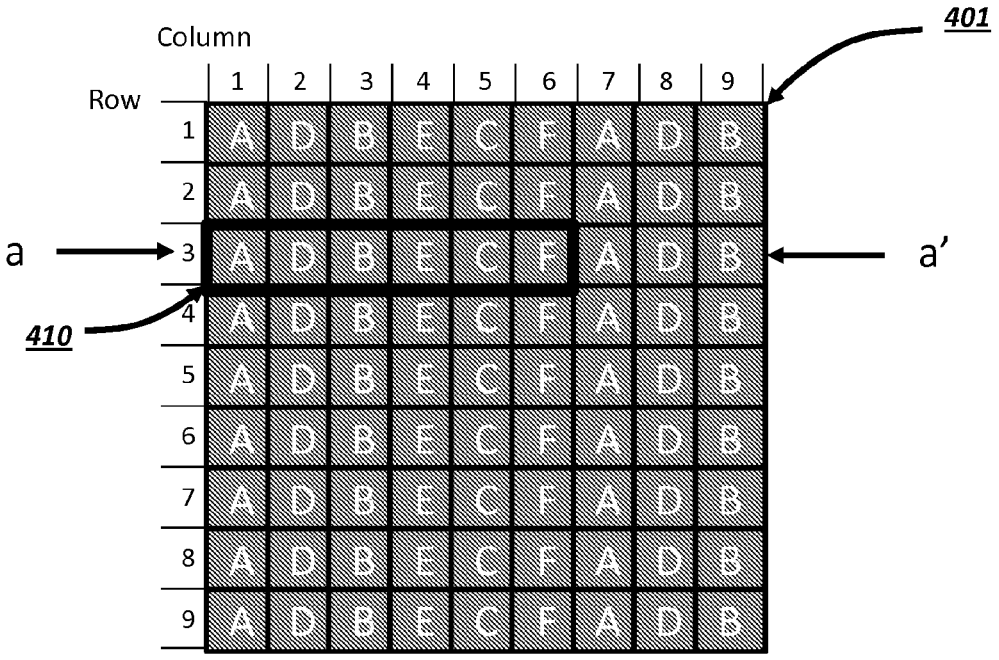
FIG. 4 is a front view of an exemplary display assembly formed by the display screens and color filter elements depicted in FIG. 3.

The two display screens, 301 and 302, and the color filter mask may be assembled (one overlaid on the other so that their planar surfaces are co-planar) to form an assembled display panel 401, with light valves controlling each sub-pixel associated with its corresponding filter, as shown in FIG. 4. Assembled display panel 401 includes an array of addressable sub-pixels with columns 1, 3, 5, 7, and 9 contributed by Display Panel 1 301 and columns 2, 4, 6, and 8 contributed by Display Panel 2 302. The display screens 301 and 302 may be overlaid over each other such that their planar surfaces are co-planar. An exemplary full-color pixel, 310, formed by the assembly of the first and second display panels 301 and 302 is shown as including sub-pixels located on row 3, columns 1-6, of both display panel 1, 301, and display panel 2, 302.

In an exemplary embodiment, a set of sub-pixels addressed on Display Panel 1 during image display may be spatially offset from a set of sub-pixels addressed on Display Panel 2 in the horizontal direction and/or the vertical direction along the plane formed by the surfaces of the panels. In the example of FIG. 4, the sub-pixels of Panel 2 addressed are spatially offset along the plane formed by the surfaces of the panels by one sub-pixel width horizontally from the sub-pixels of Panel 1 addressed to the right as shown.

In an exemplary embodiment, Display Panels 1 and 2 are configured and/or positioned relative to each other such that the addressable sub-pixels of Panel 1 are spatially offset from the addressable sub-pixels of Panel 2 in the horizontal direction and/or the vertical direction along the plane formed by the surfaces of the panels. In the example of FIG. 4, the addressable sub-pixels of Panel 2 are spatially offset along the plane formed by the surfaces of the panels by one sub-pixel width horizontally from the addressable sub-pixels of Panel 1 to the right as shown.

In the assembled display panel 401, the color filter elements of the filter mask are associated in sequence with the columns of sub-pixels in the display assembly and repeats over the columns, so that sub-pixel column 1 is associated with filter A, sub-pixel column 2 is associated with filter D, sub-pixel column 3 is associated with filter B, sub-pixel column 4 is associated with filter E, sub-pixel column 5 is associated with filter C, sub-pixel column 6 is associated with filter F, sub-pixel column 7 is associated with filter A, sub-pixel column 8 is associated with filter D, sub-pixel column 9 is associated with filter B, and the like.

In the exemplary embodiment shown in FIGS. 3 and 4, a pixel in the assembled display panel 401 includes sub-pixels associated with each color filter element—A, D, B, E, C, and F. That is, a full-pixel is one sub-pixel in height and six sub-pixels wide, in this example. Each sub-pixel may be denoted by a matrix element S(i, j), having row index, i and column index j, and is associated with only one of the color filter elements of the filter mask, e.g., A, D, B, E, C, or F in this embodiment. For example, referring to FIG. 4, the sub-pixel S(3,1) is associated with the color filter element A and the sub-pixel S(3,2) is associated with the color filter element D. A full pixel, in this embodiment, may be the sub-pixel elements S(3, j) where $1 \leq j \leq 6$. The exemplary full-color pixel 310 of FIG. 3 is shown in FIG. 4 as 410. Alternatively, a full-pixel may be defined as S(i, j) where $2 \leq j \leq 7$ or any other set of six contiguous column elements in any row i.

Figure 5:
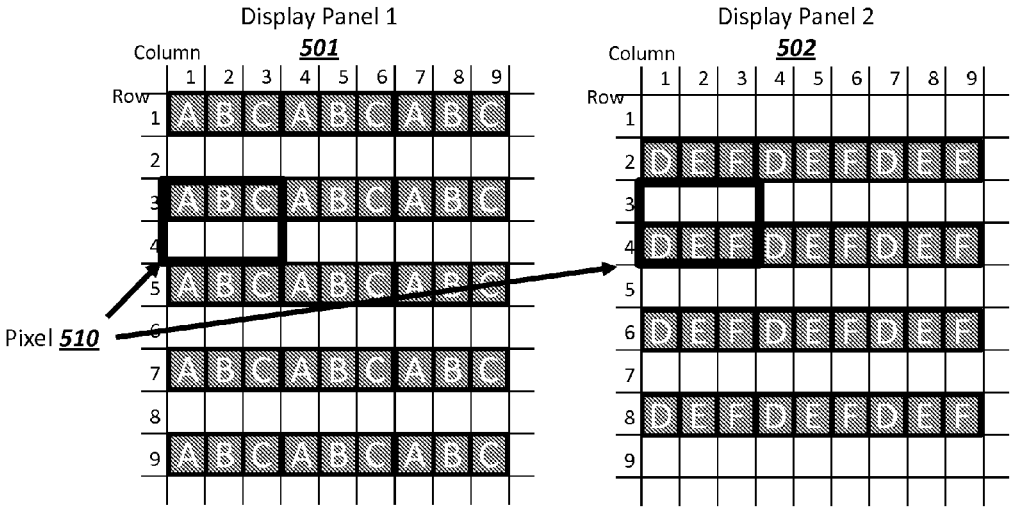
FIG. 5 depicts addressable sub-pixels of two display screens for an exemplary display assembly, showing their correspondence to associated color filter elements.
Figure 6:
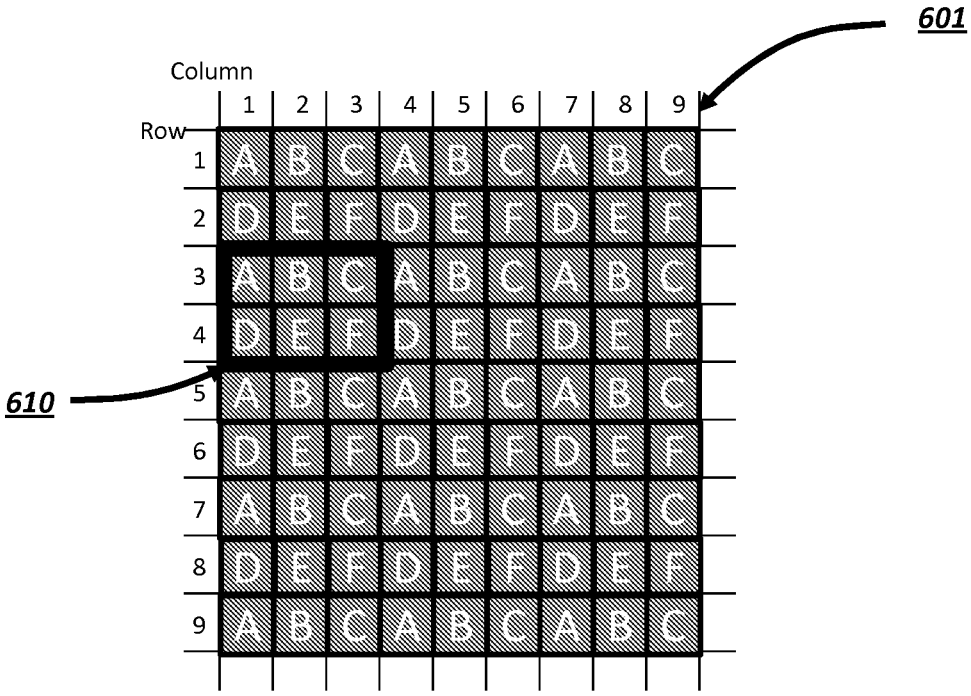
FIG. 6 is a front view of an exemplary display assembly formed by the display screens and color filter elements depicted in FIG. 5.

Other configurations of sub-pixels to form a 6-color pixel are possible. FIGS. 5 and 6 show one such alternate embodiment in which a group of sub-pixels two rows high and three columns wide, each with an associated color filter element, form a full-color pixel. In FIG. 5, sub-pixels corresponding to filter elements A, B, and C are addressed on odd-numbered rows on Display Panel 1, 501. All sub-pixels in even-numbered rows of Display Panel 1 are in a fully transmissive state so that illumination from the backlight can propagate to Display Panel 2, 502. Sub-pixels of Display Panel 2 corresponding to filter elements D, E, and F are addressed on even-numbered rows. An exemplary full-color pixel, 510, is shown as including sub-pixels located on rows 3 and 4 and columns 1, 2, and 3, of both display panel 1, 501, and display panel 2, 502.

FIG. 6 shows the sub-pixel configuration 601 resulting from combining the sub-pixel elements of display screen 501 and the sub-pixel elements of display screen 502 with the associated filter elements of the filter mask. An example of a full-color pixel 610 is shown, including sub-pixel elements of rows 3 and 4 and columns 1, 2, and 3 of both display screens 501 and 502.

A pixel in exemplary embodiments may include any number of sub-pixels greater than three, with each associated with a filter element such that the combined color space is larger than that defined by Rec. 709 or any other color space defined by three colors. Any configuration of sub-pixel elements addressed on Display Panel 2 is possible subject to the constraint that the sub-pixel elements not addressed on Display Panel 1 are in a fully transmissive state. Configurations of sub-pixels are allowed in which certain sub-pixels are not associated with a filter element. In such embodiments, certain sub-pixels of a display screen may be maintained in a non-transmissive state or the filter mask may be provide with opaque elements in those positions to block all light from the backlight.

Some filter elements of the filter mask may be selected to transmit the same color as other filter elements. A reason for doing so might be to increase the luminance of a particular color. This practice is used in standard Bayer masks, wherein two sub-pixels of green are used with one sub-pixel of red and one-sub-pixel of blue to form a full-color pixel.

Figure 7:
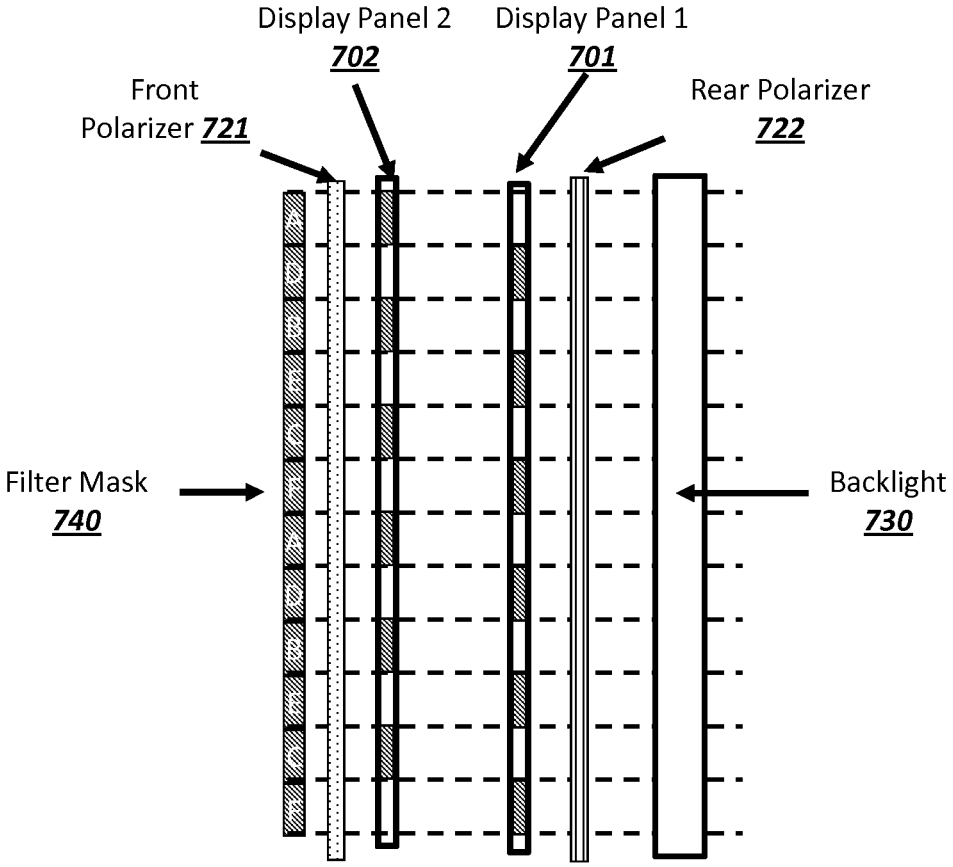
FIG. 7 shows an exploded view of a cross-section of a display assembly including the components depicted in FIG. 4.

FIG. 7 depicts an exploded view of a section taken through a-a' (or row 3) of the assembled display panel 401 in FIG. 4 showing exemplary components of the panel 401 and their configurations. A backlight 730 provides light of all desired colors to the display. Two display panels, 701 and 702, are assembled in an overlaid manner such that their planar surfaces are co-planar. The sub-pixels addressed in one panel are spatially offset from the sub-pixels addressed on the other panel along the plane formed by the panel surfaces by one-half pixel width (i.e., one sub-pixel column) horizontally with respect to each other.

Figure 8:
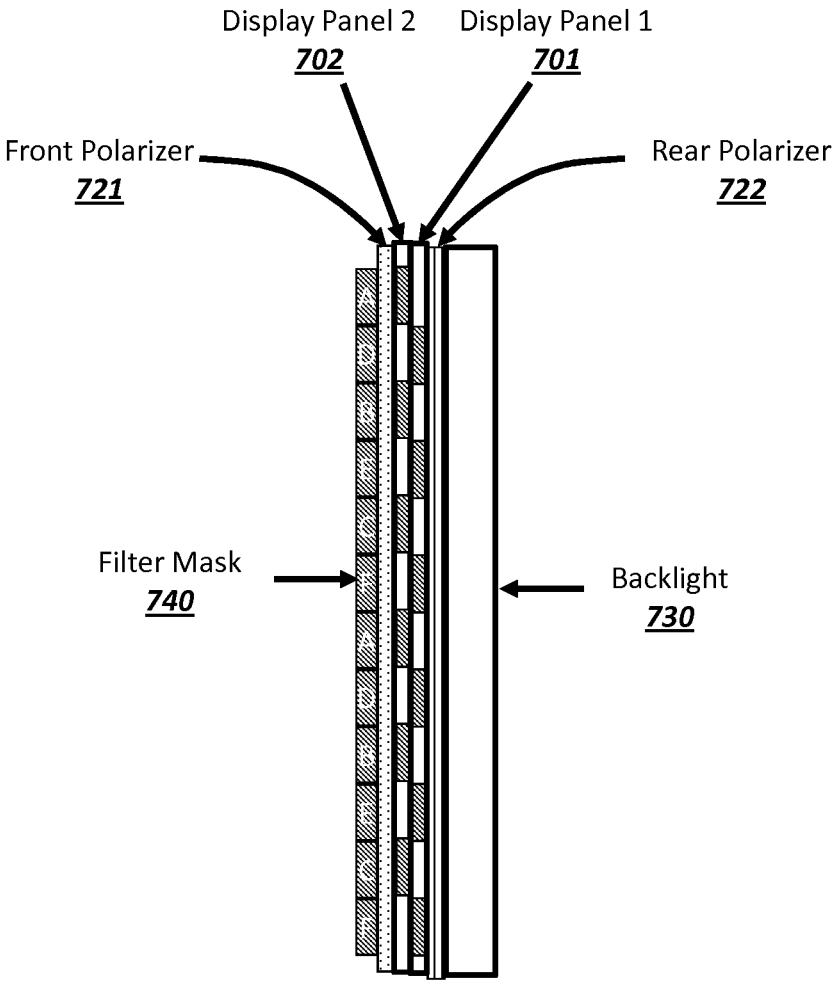
FIG. 8 shows an assembled view of the cross-section of the display assembly of FIG. 7.

FIG. 8 shows the exemplary display system of FIG. 7 as assembled. In this case, Display Panel 1, 701, and Display Panel 2, 702, are constructed separately and are abutted or overlaid over each other (so that their planar surfaces are co-planar) during assembly. Also shown in the figure are front and back polarizers, 721 and 722, respectively, the backlight, 730, and a color filter mask, 740.

Figure 9:
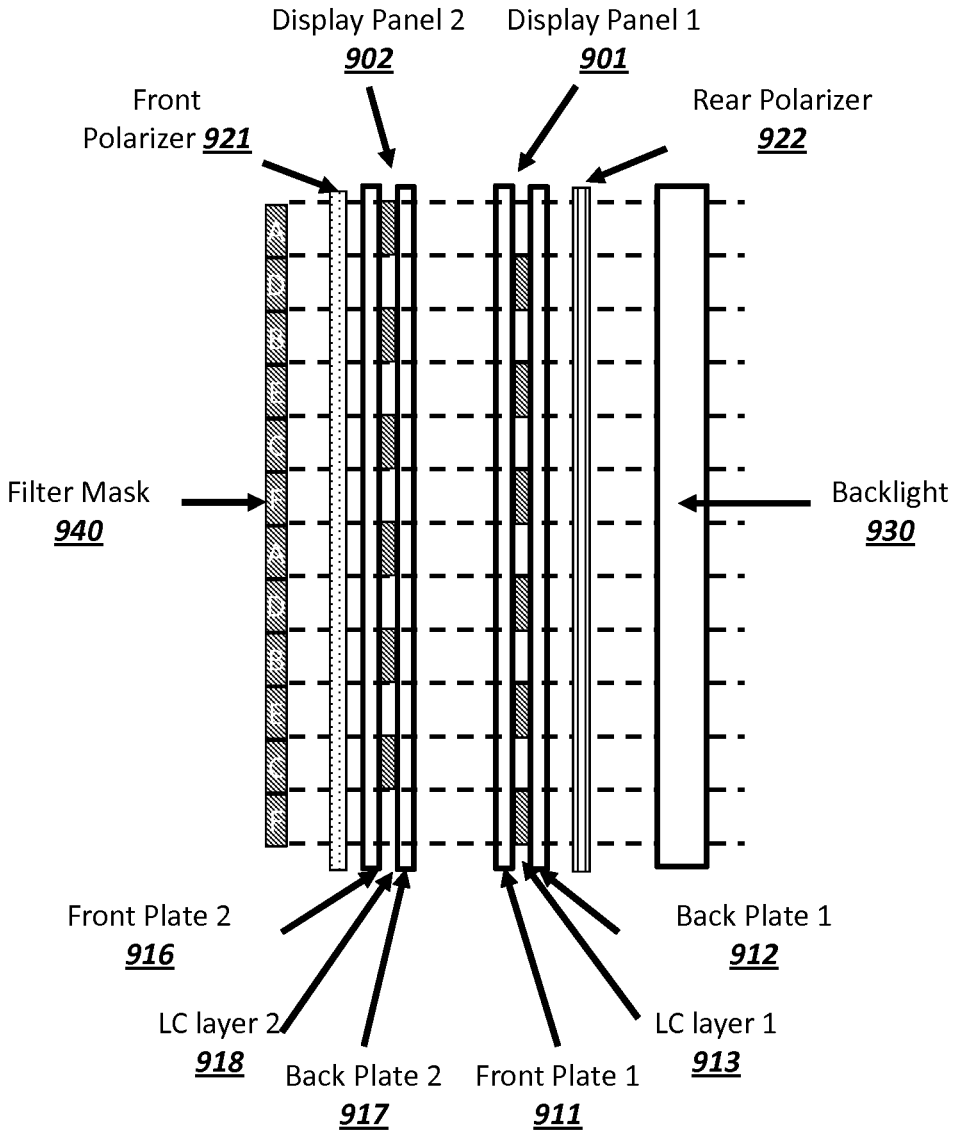
FIG. 9 shows an exploded view of a cross-section of a display assembly including the components depicted in FIG. 4 in which the exemplary display screens are LCD screens, each LCD screen each including a liquid crystal layer disposed between a front plate and a back plate.

FIG. 9 depicts an exploded view of a section taken through a-a' (or row 3) of the assembled display panel 401 in FIG. 4 showing an exemplary embodiment of the panel 401 based on use of LCD display panels. A backlight 930 provides light of all desired colors to the display. Two LCD panels, 901 and 902, are assembled in an overlaid manner such that their planar surfaces are co-planar. The sub-pixels addressed in one panel are spatially offset from the sub-pixels addressed on the other panel along the plane formed by the panel surfaces by one-half pixel width (i.e., one sub-pixel column) horizontally with respect to each other. The first LCD panel 901 includes a front plate 911 and a back plate 912 and, similarly, the second LCD panel 902 includes a front plate 916 and a back plate 917. The front and back plates are typically made of glass or plastic, the surfaces of which have been processed so as to impose a preferred direction to the liquid crystal molecules in the absence of an applied electric field. The front and back plates provide support for top and/or bottom transparent electrodes (not shown) for the application of an electric field. Each LCD panel, 901 and 902, includes a liquid crystal (LC) layer, 913 and 918, respectively, positioned between corresponding front and back plates.

In some exemplary embodiments, the LCD layers in a display assembly may be sandwiched between polarizing elements. In an exemplary embodiment, a rear polarizer 922 may be provided at the rear of the assembly (for example, between the back plate of the second panel 902 and the backlight 930) to ensure that light enters the liquid crystal from the backlight 930 in a preferred polarization. In another exemplary embodiment, a rear polarizer may be absent. In an exemplary embodiment, a front polarizer 921 may be provided at the front of the assembly (for example, between a filter mask 940 and the front plate of the first panel 901). Depending on the type of liquid crystal and the orientation scheme used, the front polarizer 921 may enable adjustment of the amount of backlight transmitted through the assembly between a minimum amount (preferably, exactly or approximately 0% of the amount of backlight) and a maximum amount (preferably, exactly or approximately 100% of the amount of backlight). In some exemplary embodiments, the amount or percentage of the backlight allowed to be transmitted through the assembly may be selected to be any desired predetermined number or range. The light transmitted through the assembly is transmitted to a filter mask 940 positioned at the front of the assembly, which, in the example shown, then transmits light of the six colors of any of the gray-levels allowed by the liquid-crystal light valves and encoding schemes (e.g., 8 bits of color=256 levels) of the LCD panels 901 and 902.

Figure 10:
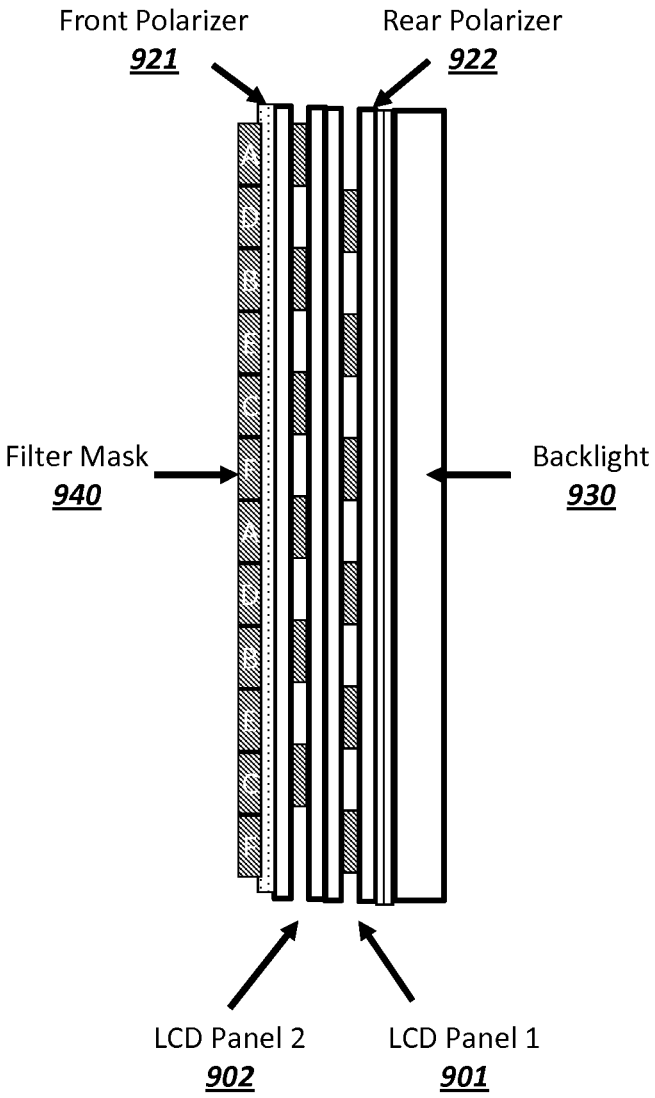
FIG. 10 shows an assembled view of the cross-section of the display assembly of FIG. 9.

FIG. 10 shows the exemplary display system of FIG. 9 as assembled. In this case, LCD Panel 1, 901, and LCD Panel 2, 902, are constructed separately and are abutted or overlaid over each other (so that their planar surfaces are co-planar) during assembly. Also shown in the figure are the front and back polarizers, 921 and 922, respectively, the backlight, 930, and the filter mask, 940.

Figure 11:
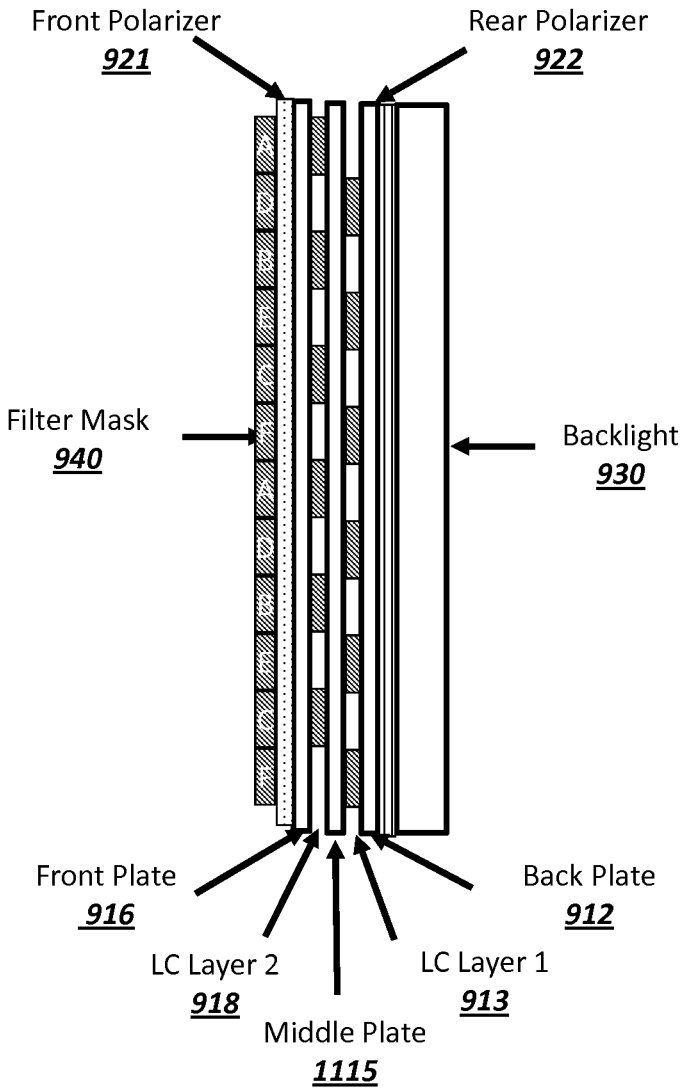
FIG. 11 shows an assembled view of a cross-section of a display assembly including the components depicted in FIG. 4 in which the display screens are LCD screens, in which the display assembly includes two liquid crystal layers, a front plate, a back plate and a middle plate disposed between the liquid crystal layers.

FIG. 11 presents another exemplary embodiment of a display system in which two liquid crystal (LC) layers, 913 and 918, are fabricated as a sandwiched structure using three, rather than four, glass plates. The system of FIG. 11 includes a first LCD panel including a back plate 912 and a LC layer 913 and, similarly, a second LCD panel including a front plate 916 and a LCD layer 918 as in the embodiment shown in FIG. 10. In the embodiment of FIG. 11, a middle plate 1115 may be provided between the LC layers 913 and 918 to separate the two display panels. The middle plate 1115 may include transparent electrodes on both surfaces, the electrode(s) on the surface facing the first LCD layer 913 to address the first LC layer 913, and the electrode(s) on the surface facing the second LC layer 918 to address the second LC layer 918.

Although FIGS. 9-11 are described with respect to liquid crystal display (LCD) technology, the exemplary embodiments of FIGS. 9-11 should not be construed as limiting, and the embodiments and principles illustrated in FIGS. 9-11 are applicable to and achievable using other types of display technology.

In the exemplary embodiments illustrated in FIGS. 5-11, the colors transmitted through the display are governed by the color filter elements of the filter mask and the backlight. As noted earlier, the backlight is able to generate the wavelengths transmitted by the color filter elements. Many approaches exist to implement such backlights including, but not limited to, a single light source emitting multiple discrete wavelengths, with at least one such wavelength corresponding to the transmission pass-band of the corresponding filter; a plurality of sources, the combined emission of which comprises the wavelengths required by the color filter elements; an array of LEDs; an array of lasers; or a white-light continuum source. One of ordinary skill in the art will appreciate that any suitable backlight may be used in exemplary systems and that exemplary embodiments are not limited to any specific types of backlight.

Figure 12:
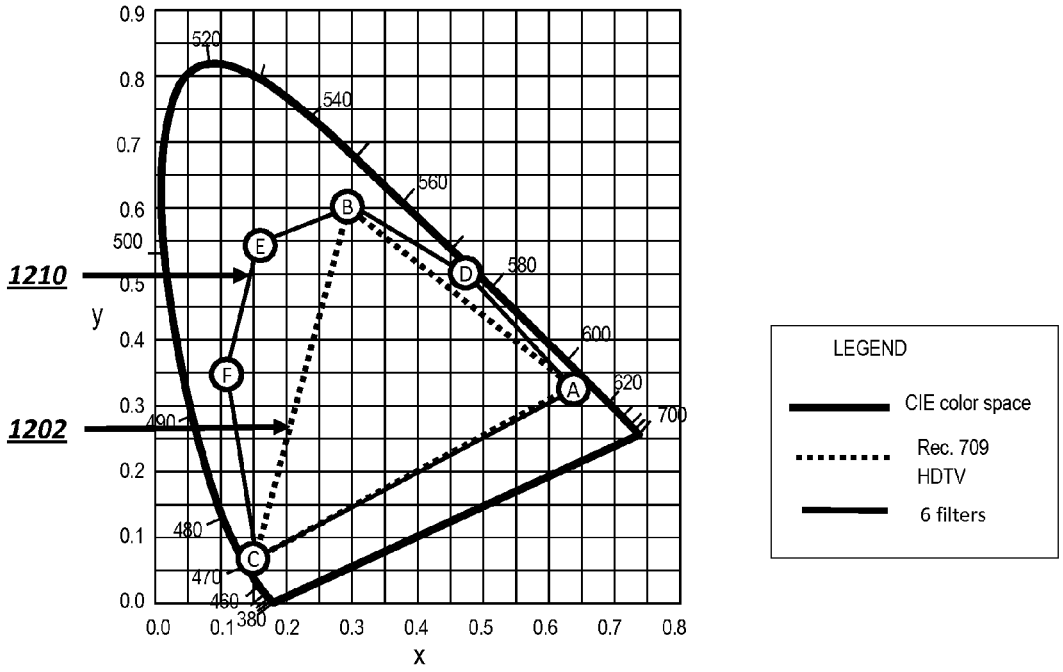
FIG. 12 is a CIE chromaticity diagram showing a color gamut achieved by the use of six color filter elements in an exemplary pixel.

Each color filter in the filter mask (740 in FIGS. 7 and 8 and 940 in FIGS. 9, 10, and 11) allows only a specific color to be transmitted through the display assembly. The combination of color filter elements in an exemplary filter mask achieves a color gamut illustrated in FIG. 12. FIG. 12 is a CIE chromaticity diagram showing a color space achieved by the use of six color filter elements in an exemplary filter mask. In an example in which the filter mask includes six color filter elements, filter elements A, B, and C may match the red, green, and blue coordinates of the conventional Rec. 709 standard color space 1202, but that does not need to be the case. In other examples in which the filter mask includes six color filter elements, filter elements A, B, and C may not match the red, green, and blue coordinates of the Rec. 709 standard color space 1202. A, B, and C, may, for example, be filter elements representing deeper red, e.g., having CIE coordinates (x=0.68, y=0.28), a more saturated green (x=0.25, y=0.70), and violet (x=0.18, y=0.04), respectively. In fact, the green coordinate of the conventional Rec. 709 color space is visually closer to yellowish-green than a true deep green. In the example shown in the figure, Filter E achieved by exemplary embodiments represents a truer green than the green coordinate of the standard color space 1202, Filter D achieved by exemplary embodiments represents yellow, and filter F achieved by exemplary embodiments represents blue-green.

As shown in FIG. 12, the color space achieved by exemplary embodiments enclosed by hexagon 1210 (A-D-B-E-F-C-A) is larger than the color space enclosed by the convention Rec. 709 triangle. That is, the color space achieved by the exemplary filter mask represents more colors, and thereby provides a richer visual sensation of color. For example, the colors A, B, and C are shown to overlie the colors red (x=0.64, y=0.33), green (x=0.30, y=0.60), and blue (x=0.15, y=0.06) of standard Rec. 709 HDTV. Colors D representing yellow (x=0.47, y=0.50), E representing green (x=0.16, y=0.50), and F representing blue-green (x=0.11, y=0.35) fall outside and expand the color space beyond that defined by Rec. 709.

Color filter elements of any type can be used to transmit the selected colors, A, B, C, D, E, and F in the above case, as well as additional filter elements G and H described below. The color filter elements in the filter mask must be selected to transmit wavelengths emitted by the backlight. The color filter elements may be selected to transmit wavelengths defined within the CIE color space or to any extended color space, which might include ultraviolet and/or infrared wavelengths. The color filter elements corresponding to the selected colors may be comprised of dyed gelatin, dielectric bandpass stacks, or any other convenient type. Exemplary color filters may transmit any suitable number of colors for a pixel including, but not limited to, 4, 5, 6, 7, 8, 9, 10, and the like. In certain exemplary embodiments, a pixel may be formed by two or more sub-pixels associated with color filter elements transmitting the same color, in order to increase the luminance of that color.

Any suitable backlight may be used as a source of light incident upon the display screens in an exemplary display system. A backlight may include a plurality of laser emission wavelengths that, because of their narrow line-widths, lie on or close to the heavy black line denoting the total CIE color space of FIG. 12. A backlight may include a continuum source, e.g., light provided by a short-duration second pulsed laser. In addition, a backlight may provide wavelengths outside the range of human vision, i.e., outside the CIE color space. Such backlights may extend to the ultraviolet and/or the infrared. More conventional backlights are made using cold-cathode fluorescent lamps (CCLFs) or arrays of light-emitting diodes (LEDs). Such backlights may be created to provide wavelengths outside of the triangle in CIE color space of Rec. 709 for HDTV. Any suitable backlight, including the above-referenced types of backlight, may be used in exemplary display systems. An exemplary filter mask may be selected and/or configured to filter light of one or more particular ranges of wavelengths emitted by the backlight. The range of wavelengths transmitted by a filter in the filter mask may fall within the visual spectrum (e.g., visible colors) or outside the visual spectrum (e.g., ultraviolet and/or infrared).

In the exemplary display system of FIGS. 9 and 10, Display Panel 2 is overlaid on Display Panel 1 such that the light from the backlight reaches Display Panel 1 first. Part of the light emitted by the backlight is transmitted unchanged through Display Panel 1 to Display Panel 2, e.g., by maintaining exactly or approximately 100% transmission in the sub-pixels of LCD Panel 1 by providing an addressing voltage to such sub-pixels such that the corresponding liquid crystal layers are in a transmitting state. In this exemplary sub-pixel configuration, the resulting display includes only sub-pixels that transmit a particular one of the component colors, A, B, C, D, E, or F; no sub-pixel of the assembled display transmits the unfiltered light of the backlight.

Figure 13:
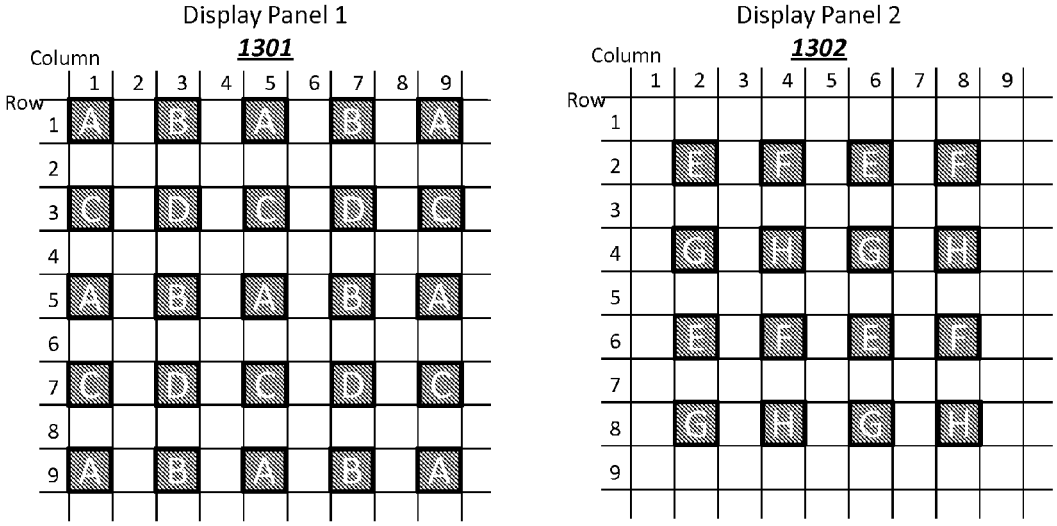
FIG. 13 depicts addressable sub-pixels of two display screens for an exemplary display assembly, showing their correspondence to associated color filter elements.
Figure 14:
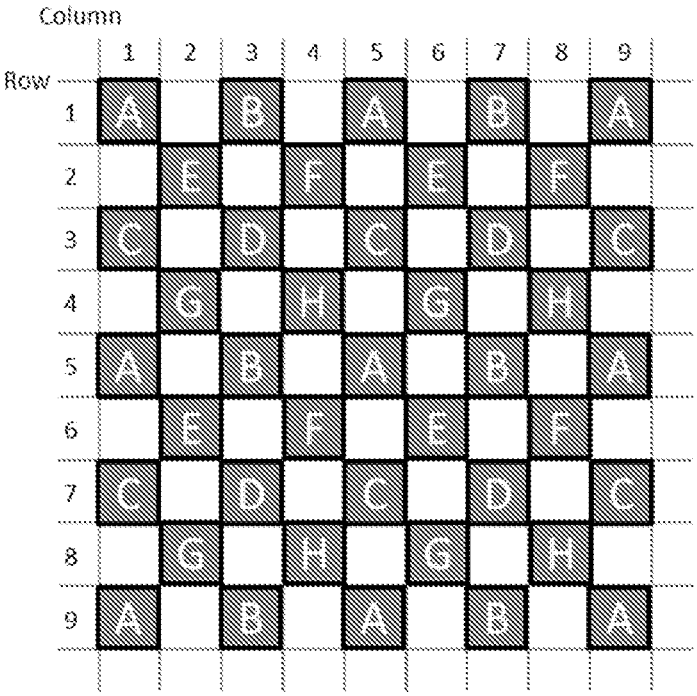
FIG. 14 is a front view of an exemplary display assembly formed by the display screens and color filter elements depicted in FIG. 13.

FIGS. 13 and 14 represent another exemplary embodiment in which sub-pixels addressed on one panel are offset from sub-pixels addressed on another panel in two dimensions, for example, the vertical dimension and the horizontal dimension along the plane of the display panels. In use during image display, a set of pixels addressed on one panel are spatially offset from a set of pixels addressed on the other panel along the planar surfaces of the panels by one-half pixel width (i.e., one sub-pixel column) horizontally with respect to each other and by one-half pixel height (i.e., one sub-pixel row) vertically with respect to each other.

In an example, four colors are enabled by each of the display panels so that eight colors are represented by the display system. In this case, Display Panel 1, 1301, enables colors A, B, C, and D and Display Panel 2, 1302, enables colors E, F, G, and H, a total of eight colors For this configuration, the sub-pixels are not as densely packed as are the case shown in FIGS. 3 and 5. In the present case, the sub-pixels of Display Panel 1 that correspond to a color filter of the Bayer mask and Display Panel 2 that correspond to a color filter of the Bayer mask comprise only one-fourth of the total number of sub-pixels available on each panel. Thus, the assembled panels, in which Display Panel 1 and Display Panel 2 are overlaid, form a checkerboard pattern, as shown in FIG. 14, in which only those sub-pixels corresponding to a lettered sub-pixel on the Bayer mask (i.e., colors A, B, C, D, E, F, G, or H) are allowed to transmit light from the backlight. The other pixels, shown as white in FIGS. 13 and 14, may be maintained in a non-transmissive state, so that essentially none of the backlight illumination passes through them. Alternatively, opaque filter elements corresponding to these other pixels may be opaque to prevent any backlight illumination from passing through them.

In another exemplary embodiment, some of the pixels of FIGS. 13 and 14 may incorporate infrared (IR) or ultraviolet (UV) filters to display images hidden from human vision but visible to IR or UV sensitive cameras.

Figure 15:
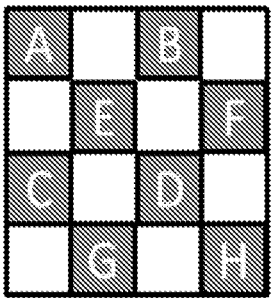
FIG. 15 shows a pixel of the exemplary display assembly corresponding to the exemplary sub-pixel arrangements of FIG. 14.

The pixel of this exemplary assembly has dimensions equal to four sub-pixels in width and four sub-pixels in height, thereby including all of the colors of the 8-color filter mask, A, B, E, F, C, D, G, and H, as shown in FIG. 15.

Figure 16:
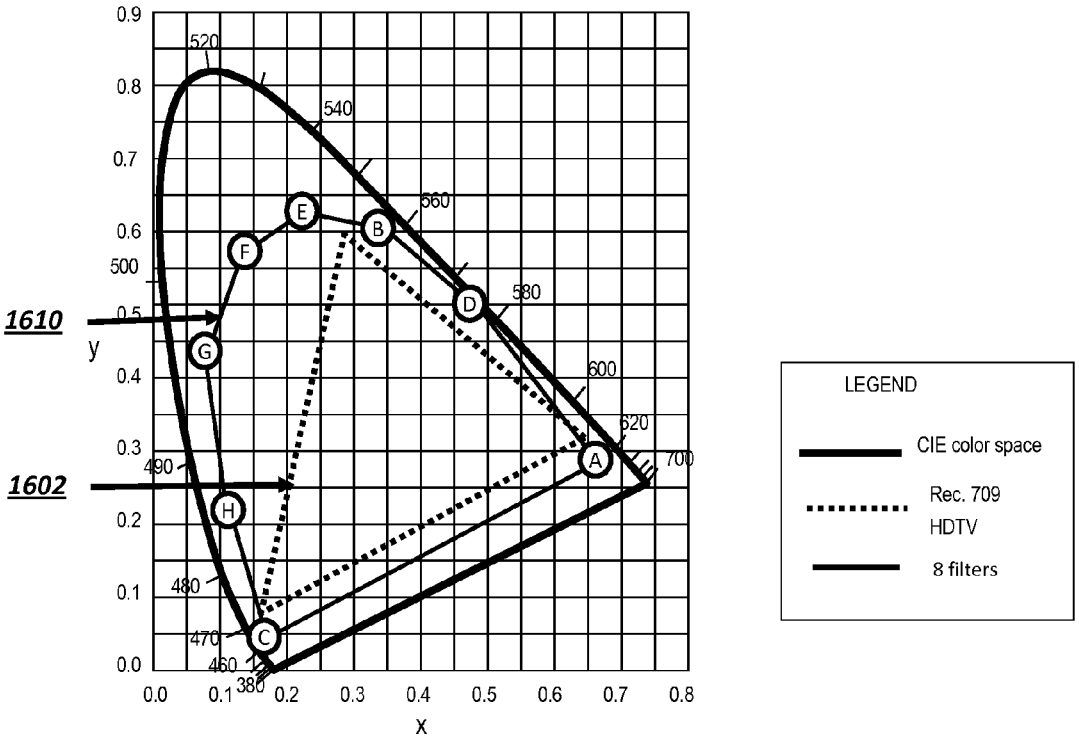
FIG. 16 is a CIE chromaticity diagram showing a color gamut achieved by the use of eight color filter elements in an exemplary pixel.

As can be seen in FIG. 16, the enhanced color space achieved by the system of FIGS. 13-15 is represented by an octagon 1610 encompassing a greater range of colors than the Rec. 709 color gamut 1602. In this example, color filter elements A and C are shown as being capable of transmitting deeper reds and blues than in the case of Rec. 709. Filter C, as shown in this example, enables perception of violet colors that are not accessible in the ITU-Recommendation 709 color space for current HDTV. Greater resolution and greater saturation of blue and blue-green hues are provided. The exemplary x, y coordinates of the eight colors shown in FIG. 12 are A (x=0.66, y=0.28), B (x=0.33, y=0.60), C (x=0.17, y=0.05), D (x=0.47, y=0.50), E (x=0.27, y=0.62), F (x=0.14, y=0.58), G (x=0.08, y=0.44), and H (x=0.12, y=0.22).

Figure 17:
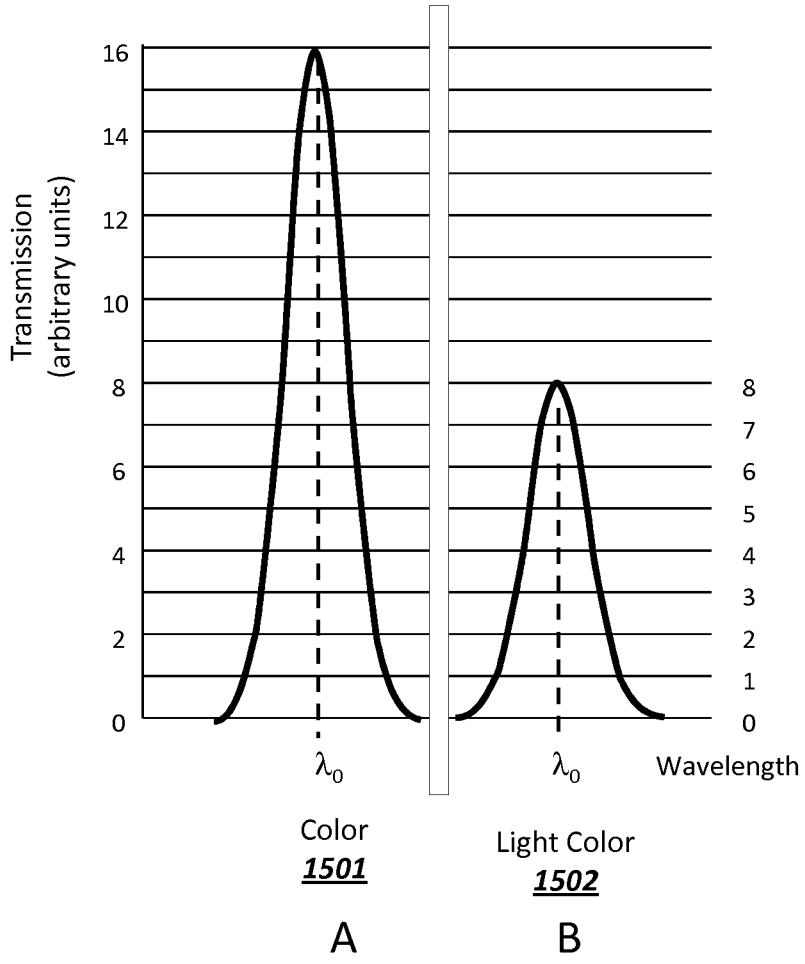
FIGS. 17A and 17B show exemplary transmission spectra generated by two exemplary filter elements transmitting the same color to impart finer control over grayscale intensities for that color.

In order to increase the dynamic range of the displayed images, one or more filter elements provided in accordance with exemplary embodiments may be used to decrease or narrow the range of grayscale intensities for a particular color. Exemplary color filter elements may be used to restrict the grayscale intensity range of an original intensity range to a lower portion of the intensity range, i.e., dimming the grayscale at one or more wavelengths. FIGS. 17A and 17B show exemplary transmission spectra generated by two exemplary filter elements of the same color to impart finer control over grayscale intensities for that color. In FIGS. 17A and 17B, the y-axis represents transmission intensity (in arbitrary units, which may be any unit measuring intensity) and the x-axis represents wavelengths of light transmitted by the filter elements. Both exemplary filter elements correspond to the same color and transmit light centered at wavelength $\lambda_0$, i.e., have a peak transmission intensity at wavelength $\lambda_0$.

The filter labeled "Color" corresponding to spectrum 1501 is configured and selected to transmit grayscale intensities centered exactly or approximately at wavelength $\lambda_0$ that range from exactly or approximately 0% to exactly or approximately 100% (represented as 16 arbitrary units along the y-axis) of the original grayscale intensities. The filter labeled "Light Color" corresponding to spectrum 1502 is configured and selected to transmit grayscale intensities centered exactly or approximately at wavelength $\lambda_0$ that range from exactly or approximately 0% to substantially less than 100% (represented as eight arbitrary units along the y-axis). In this case, the "Light Color" filter has the capability of transmitting up to exactly or approximately 50% of the maximum transmission of the "Color" filter at wavelength $\lambda_0$.

One of ordinary skill in the art will recognize that the "Color" and "Light Color" filter elements are exemplary filter elements, and that exemplary embodiments may provide other filter elements that reduce the grayscale intensity at the peak wavelength $\lambda_0$ by percentages other than 50%. For example, other filter elements may enable reduction in the grayscale intensity at the peak wavelength $\lambda_0$ by exemplary percentages compared to the original image by, for example, 5%, 10%, 15%, 20%, 25%, 30%, 35%, 40%, 45%, 50%, 55%, 60%, 65%, 70%, 75%, 80%, 85%, 90%, 95%, and any intermediate percentages, and the like.

Exemplary filter elements may be used to increase the resolution or level of control with which grayscale intensities may be controlled. For example, by restricting the absolute range of grayscale intensities, the "Light Color" filter corresponding to spectrum 1502 may enable more precise control of intensity in the dimmer portions of an image, compared to the level of control enabled by the "Color" filter corresponding to spectrum 1501. In an example, the luminance of each color may be controlled by an instruction encoded as a 3-bit word, enabling control of grayscale intensity in eight discrete levels of intensity. Since the use of the "Color" filter corresponding to spectrum 1501 results in a larger absolute range of intensities, each discrete level by which the intensity may be increased or decreased by an instruction corresponds to two arbitrary units along the y-axis. For example, the intensity in spectrum 1501 may be controlled among 0, 2, 4, 6, 8, 10, 12, 14, and 16 arbitrary units along the y-axis. Since the use of the "Light Color" filter corresponding to spectrum 1502 results in a smaller range of intensities at the dimmer grayscale, each discrete level by which the intensity may be increased or decreased by an instruction corresponds to one arbitrary unit along the y-axis. For example, the intensity in spectrum 1501 may be controlled among 0, 1, 2, 3, 4, 5, 6, 7, and 8 arbitrary units along the y-axis using a 3-bit word instruction. Exemplary "Light Color" filter thereby enables more precise and higher resolution control over the intensity at the dimmer or less intense grayscale range of an image.

Figure 18:
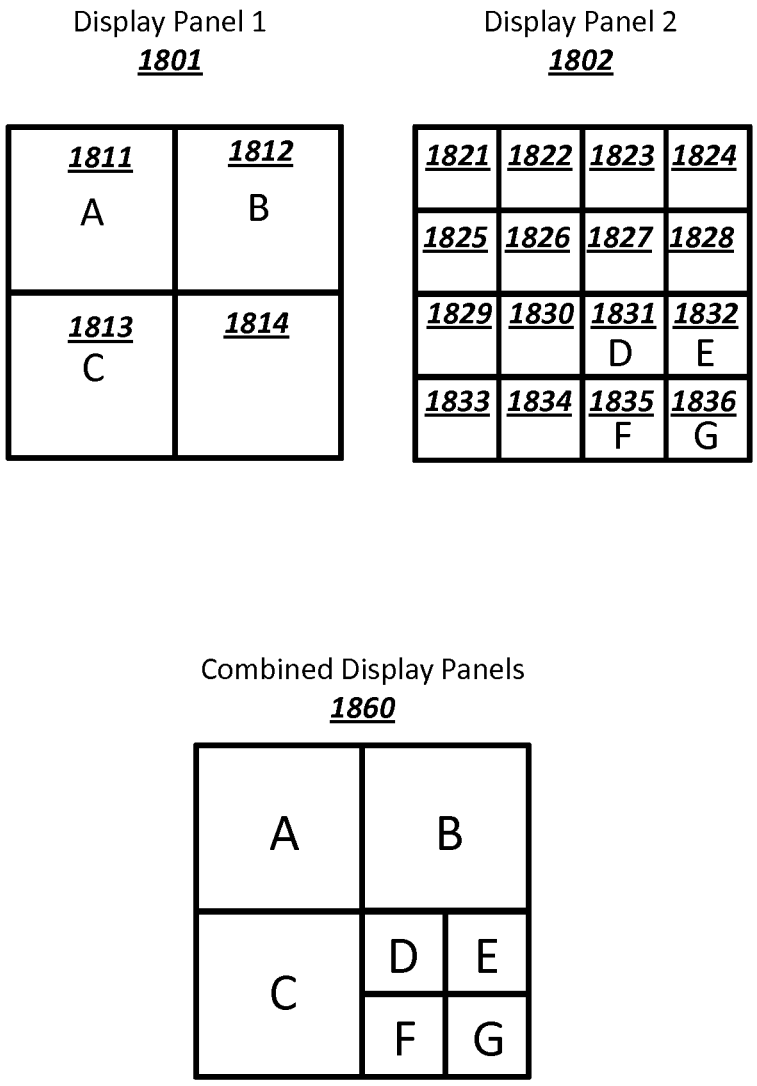
FIG. 18 depicts an exemplary layout of sub-pixels on a first display screen, a second display screen, and a display assembly formed using the first and second display screens.

In another embodiment, Display Panel 1 and Display Panel 2 may have different native resolutions, wherein the dimension of a sub-pixel on one of the two panels is an integral multiple of the dimension of the sub-pixel on the other panel. FIG. 18 depicts an embodiment wherein Display Panel 2, 1802, is comprised of sub-pixels one-half the linear size (one-quarter the area) of the sub-pixels of Display Panel 1, 1801.

FIG. 18 depicts exemplary sub-pixels 1811, 1812, 1813, and 1814 of Display Panel 1, 1801, each having a height 1841 and a width 1842 that are twice that of the height 1851 and width 1852, respectively, of exemplary sub-pixel 1821 through 1836 of Display Panel 2, 1802. The four sub-pixels 1811, 1812, 1813, and 1814 of Display Panel 1, 1801, may, for example, form a full-color pixel of 1801. In this exemplary embodiment, sub-pixel 1811 is associated with color filter A, sub-pixel 1812 is associated with color filter B, and sub-pixel 1813 is associated with color filter C. Sub-pixel 1814 is not associated with any color filter, i.e., all light passing through 1814 is allowed to pass unfiltered to Display Panel 2, 1802.

An exemplary set of four sub-pixels, 1831, 1832, 1835, and 1836, may form a full-color pixel of Display Panel 2, 1802. Light that passes though sub-pixel 1814 of Display Panel 1, 1801, may be subsequently modulated by the set of four sub-pixels, 1831, 1832, 1835, and 1836, which are associated with color filter elements D, E, F, and G, respectively.

Upon assembly of the display panels 1801 and 1802 in an overlaid manner, the resultant combined sub-pixel configuration, 1860, includes three larger sub-pixels associated with color filter elements A, B, and C, and four smaller sub-pixels associated with color filter elements D, E, F, and G. Thus, admixtures of different colors can be produced that allow more precise control of a desired color space.

Figure 19:
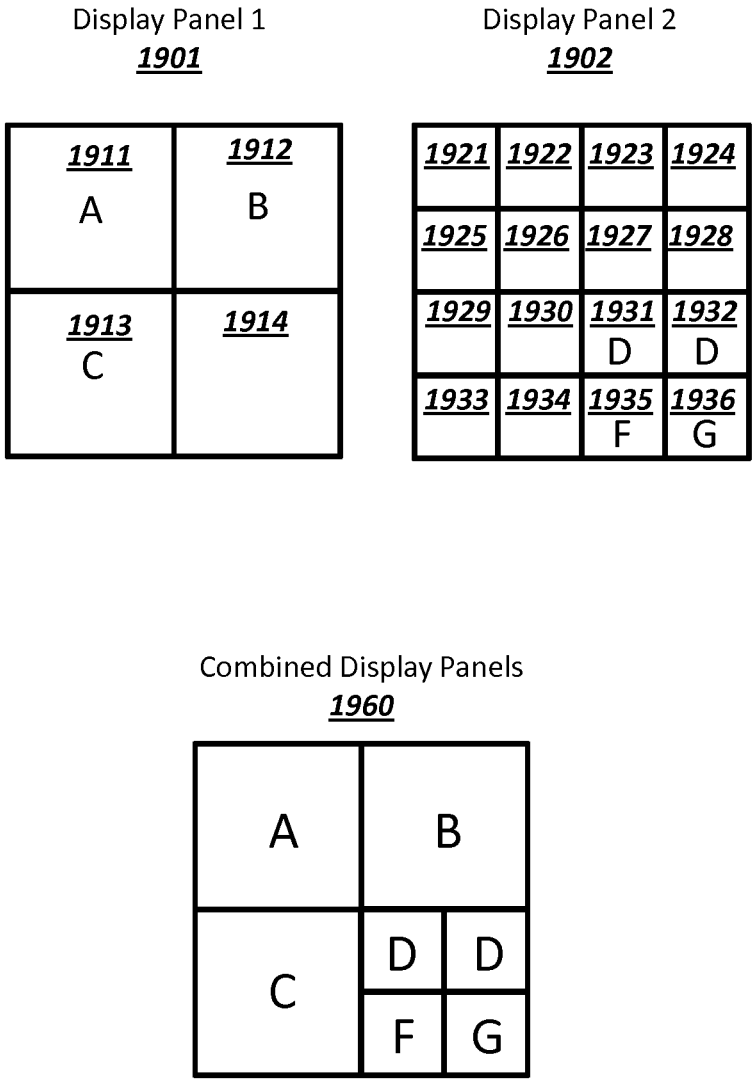
FIG. 19 depicts an exemplary layout of sub-pixels on a first display screen, a second display screen, and a display assembly formed using the first and second display screens.
Figure 20:
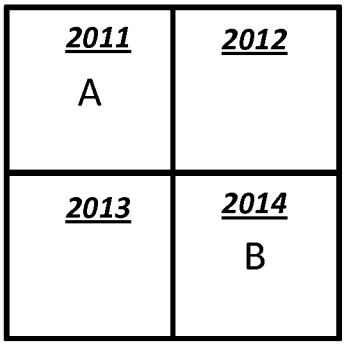
FIG. 20 depicts an exemplary layout of sub-pixels on a first display screen, a second display screen, and a display assembly formed using the first and second display screens.
Figure 20:
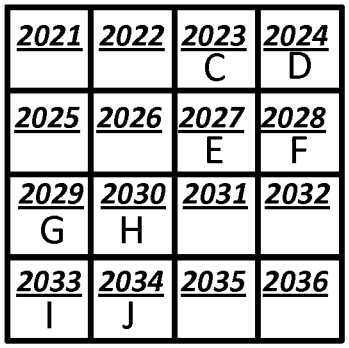
Figure 20:
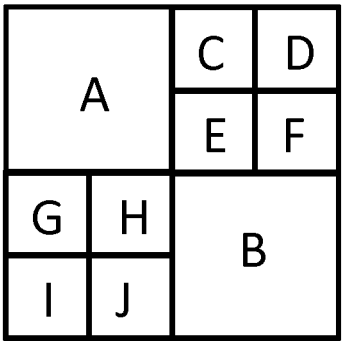

FIGS. 19 and 20 depict two of many possible variations of the configuration shown in FIG. 18. The configuration of FIG. 19 is identical to that of FIG. 18 except that two sub-pixels, 1931 and 1932, are associated with color filter D and none with color filter E, shown in the resultant combined sub-pixel configuration 1960. This configuration allows finer control of the luminance of one or more specific colors forming a full-color pixel of the assembled display. Sub-pixels 1911, 1912, and 1913, of Display Panel 1, 1901, are associated with color filter elements A, B, and C, respectively while sub-pixel 1914 transmits all incident light. Sub-pixels 1935 and 1936 of Display Panel 2, 1902, are associated with color filter elements F and G while sub-pixels 1921, 1922, 1923, 1924, 1925, 1926, 1927, 1928, 1929, 1930, 1933, and 1934 of Display Panel 2, 1902 are fully transmissive.

FIG. 20 depicts a configuration in which two sub-pixels, 2011 and 2014, of Display Panel 1, 2001 are associated with color filter elements A and B, respectively, while the other two sub-pixels, 2012 and 2014, are maintained in a fully transmissive state allowing light passing through them to be incident on Display Panel 2, 2002. Display Panel 2, 2002, is configured such that sub-pixels 2023, 2024, 2027, and 2028 are associated with color filter elements C, D, E, and F, respectively, and sub-pixels 2029, 2030, 2033, and 2034, are associated with color filter elements G, H, I, and J, wherein I and J are additional color filter elements with corresponding CIE color coordinates. The configuration of FIG. 20, therefore, allows ten different component colors to form a combined sub-pixel configuration 2060. As in FIG. 19, some sub-pixels may be associated with the same color, thereby allowing finer control of the luminance of a particular color. Also, any three sub-pixels of Display Panel 1, 2001, may be maintained in a fully transmissive state allowing light to reach 12 sub-pixels of Display Panel 2, 2002, thereby enabling use of up to a total of 13 colors in the combined sub-pixel 2060.

Figure 21:
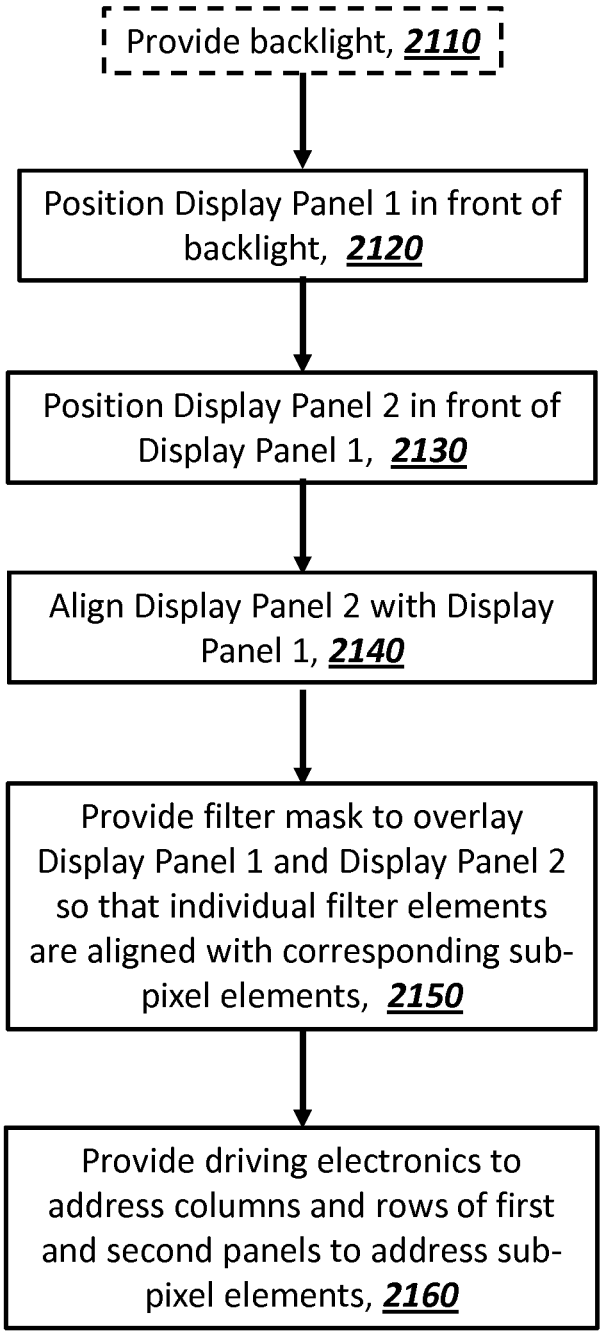
FIG. 21 is a flow chart of a method of assembling two display screens to provide an enhanced color resolution display.

FIG. 21 depicts a method of assembly of an enhanced color resolution display. In step 2120, Display Panel 1 is provided. If the display panel is of a transmissive type, a backlight must be provided in step 2110. A backlight may be integrated with the first display panel, as is the case for LCD TVs, in which case step 2110 is omitted. A second transmissive display panel, Display Panel 2, is positioned between the viewer and the first display panel is step 2130. In step 2140, Display Panel 2 is aligned with Display Panel 1 such that their planar surfaces are co-planar. In an exemplary embodiment, a set of sub-pixels addressed on Display Panel 1 is spatially offset from a set of sub-pixels addressed on Display Panel 1 in a vertical direction and/or a horizontal direction along planar surfaces of the first and second display screens. In an exemplary embodiment, a set of addressable sub-pixels of Display Panel 2 is spatially offset from a set of addressable sub-pixels of Display Panel 1 in a vertical direction and/or a horizontal direction along planar surfaces of the first and second display screens, according to the configuration selected for the associated filter mask elements.

A color filter mask is provided in step 2150 having two sets of color filter elements, a first set corresponding to and aligned with sub-pixels on Display Panel 1, and a second set corresponding to and aligned with sub-pixels on Display Panel 2. Electronics are provided to drive the rows and columns of the two display panels to selectively address the sub-pixels on the display panels, in step 2160. FIG. 21 represents an exemplary order for assembling an enhanced color resolution display. The steps of FIG. 21 can be performed in other orders.

Figure 22:
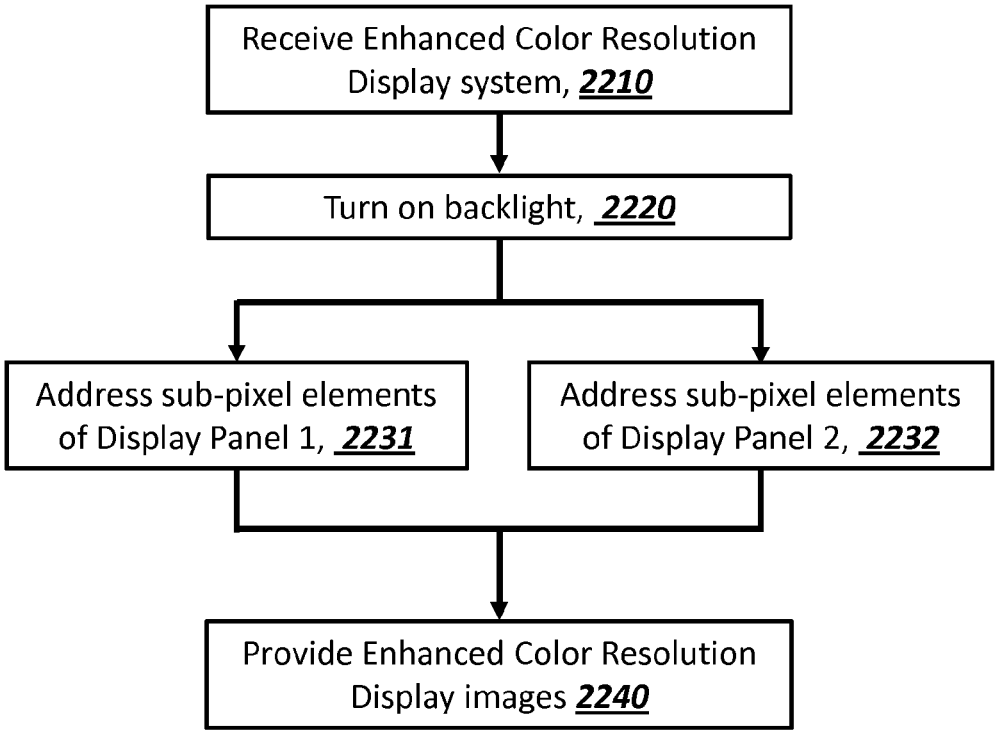
FIG. 22 is a flow chart of a method of operation of a display assembly providing an enhanced color display.

FIG. 22 depicts a method of operation of an enhanced color resolution display. In step 2210, an assembled Enhanced Color Resolution Display is received. The backlight is turned on in step 2220. The sub-pixels of Display Panel 1 and Display Panel 2 are cooperatively and selectively addressed in steps 2331 and 2332, respectively. The images provided by the above steps provide an enhanced color resolution display in step 2240.

Figure 25:
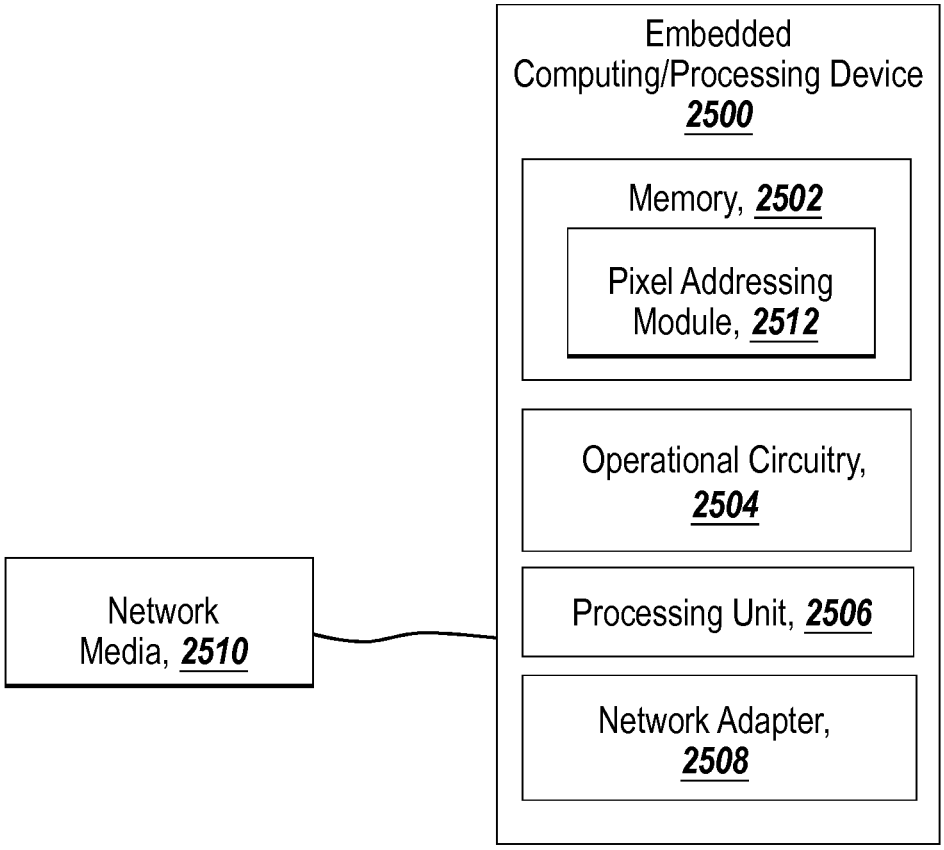
FIG. 25 is a block diagram of an exemplary embedded computing and/or processing device configurable to perform any of the methods and/or to implement any of the systems taught herein.

The addressing of the sub-pixels of one or more display screens may be performed by the use of driving electronics and computing systems and devices specially configured to perform exemplary embodiments. The computing device may include a processing module specially configured and/or programmed to include computer-executable instructions to selectively and cooperatively address a first set of sub-pixels on a first display screen and a second set of sub-pixels on a second display screen. Exemplary computer devices are shown in FIGS. 23 and 25 but are not limited to these illustrative examples.

Figure 23:
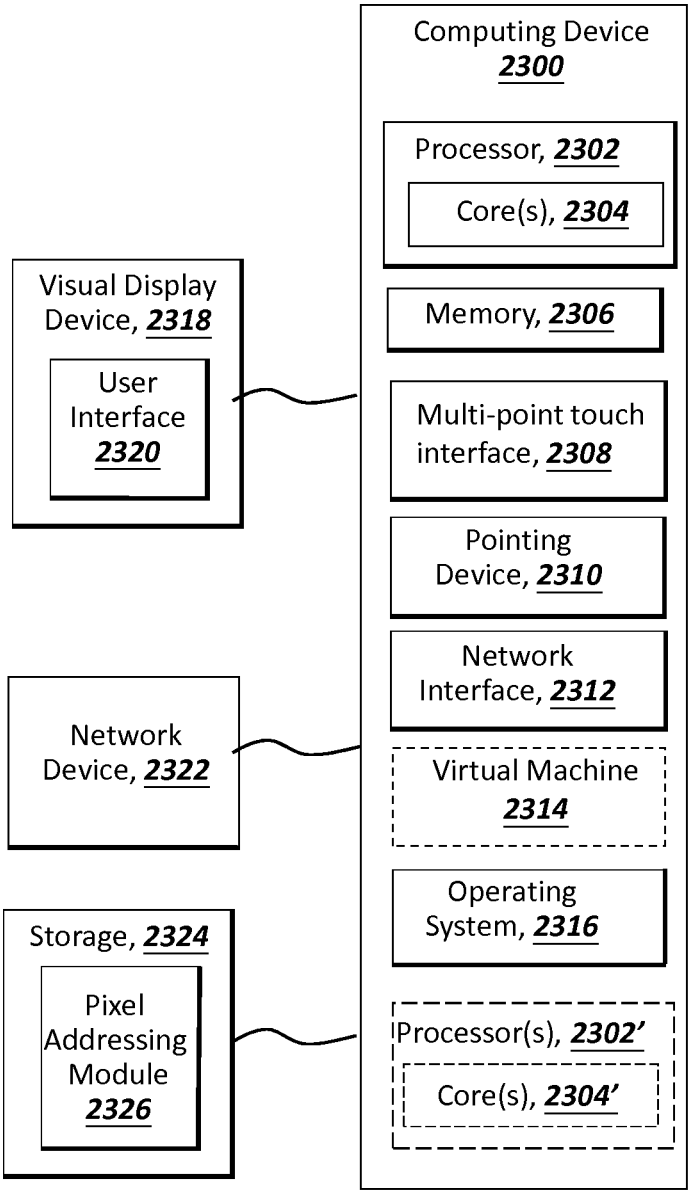
FIG. 23 depicts an exemplary computing device configurable to perform any of the methods and/or to implement any of the systems taught herein.

FIG. 23 is a block diagram of an exemplary computing device 2300 that may be used to perform any of the methods or implement any of the systems and devices provided by exemplary embodiments. For example, the computer device 2300 may be used to select one or more sub-pixels to address in a display screen. The computing device 2300 includes one or more non-transitory computer-readable media for storing one or more computer-executable instructions or software for implementing exemplary embodiments. The non-transitory computer-readable media may include, but are not limited to, one or more types of hardware memory, non-transitory tangible media, and the like. For example, memory 2306 included in the computing device 2300 may store computer-executable instructions or software for implementing exemplary embodiments. Memory 2306 may include a computer system memory or random access memory, such as DRAM, SRAM, EDO RAM, and the like. Memory 2306 may include other types of memory as well, or combinations thereof.

The computing device 2300 includes processor 2302 and, optionally, one or more additional processor(s) 2302' for executing computer-executable instructions or software stored in the memory 2306 and one or more other programs for controlling system hardware. Processor 2302 and optional processor(s) 2302' may each be a single core processor or multiple core (2304 and 2304') processor. Virtualization may be employed in the computing device 2300 so that infrastructure and resources in the computing device may be shared dynamically. A virtual machine 2314 may be provided to handle a process running on multiple processors so that the process appears to be using only one computing resource rather than multiple computing resources. Multiple virtual machines may also be used with one processor.

A user may interact with the computing device 2300 through a visual display device 2318, such as a computer monitor, which may display one or more user interfaces 2320 or any other interface. In exemplary embodiments, the display device 2318 may output or display, for example, the color space of the assembled enhanced color resolution display. The display device 2318 may also display other aspects, elements and/or information or data associated with exemplary embodiments.

The computing device 2300 may include other I/O devices such a keyboard or a multi-point touch interface 2308 and a pointing device 2310, for example a mouse, for receiving input from a user. The keyboard 2308 and the pointing device 2310 may be connected to the visual display device 2318. The computing device 2300 may include other suitable conventional I/O peripherals. The computing device 2300 may also include a storage device 2324, such as a hard-drive, CD-ROM, or other computer readable media, for storing data and computer-readable instructions or software that implement exemplary embodiments. Storage device 2324 may include a pixel addressing module 2326 for storing data and computer-readable instructions that implement and perform methods associated with addressing a first set of sub-pixels on a first display screen (e.g., by driving electrodes on the first display screen) and a second set of sub-pixels on a second display screen (e.g., by driving electrodes on the second display screen), such that the first set of sub-pixels addressed is spatially offset from the second set of sub-pixels addressed in a vertical direction and/or a horizontal direction along the planes formed by the surfaces of the first and second display screens. In some exemplary embodiments, the pixel addressing module 2326 may be provided in memory 2306.

The computing device 2300 may include a network interface 2312 configured to interface via one or more network devices 2322 with one or more networks, for example, Local Area Network (LAN), Wide Area Network (WAN) or the Internet through a variety of connections including, but not limited to, standard telephone lines, LAN or WAN links (for example, 802.11, T1, T3, 56 kb, X.25), broadband connections (for example, ISDN, Frame Relay, ATM), wireless connections, controller area network (CAN), or some combination of any or all of the above. The network interface 2312 may include a built-in network adapter, network interface card, PCMCIA network card, card bus network adapter, wireless network adapter, USB network adapter, modem or any other device suitable for interfacing the computing device 2300 to any type of network capable of communication and performing the operations described herein. Moreover, the computing device 2300 may be any computer system, such as a workstation, desktop computer, server, laptop, handheld computer or other form of computing or telecommunications device that is capable of communication and that has sufficient processor power and memory capacity to perform the operations described herein.

The computing device 2300 may run any operating system 2316, such as any of the versions of the Microsoft® Windows® operating systems, the different releases of the Unix and Linux operating systems, any version of the MacOS® for Macintosh computers, any embedded operating system, any real-time operating system, any open source operating system, any proprietary operating system, any operating systems for mobile computing devices, or any other operating system capable of running on the computing device and performing the operations described herein. The operating system 2316 may be run in native mode or emulated mode. In an exemplary embodiment, the operating system 2316 may be run on one or more cloud machine instances.

Figure 24:
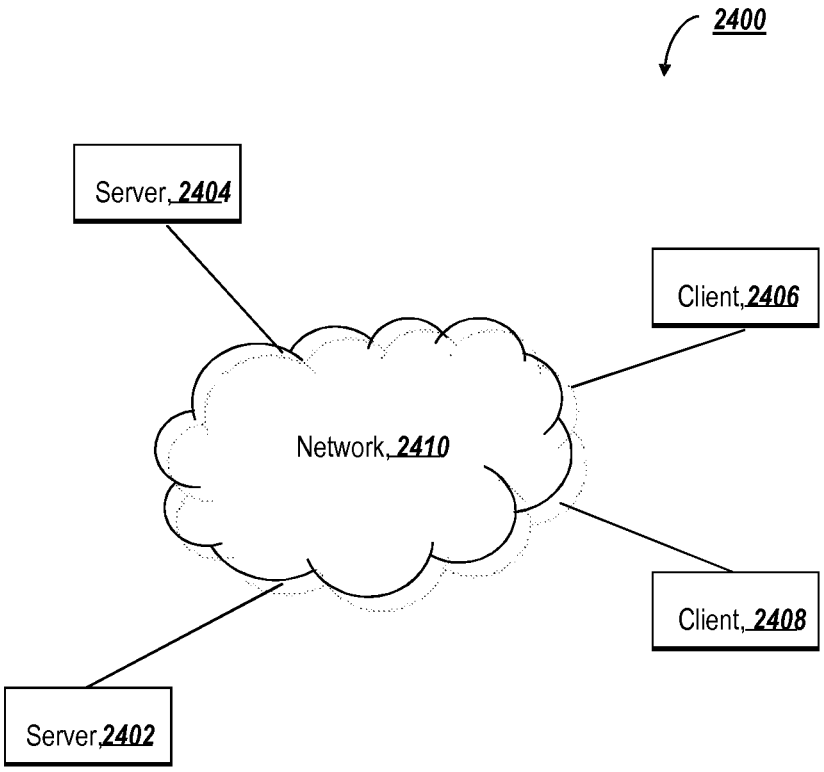
FIG. 24 depicts an exemplary network environment in which a computing device can be used to perform any of the methods and/or to implement any of the systems taught herein.

FIG. 24 is an exemplary network environment 2400 suitable for a distributed implementation of exemplary embodiments. The network environment 2400 may include one or more servers 2402 and 2404 coupled to one or more clients 2406 and 2408 via a communication network 2410. The network interface 2312 and the network device 2322 of the exemplary computing device 2300 enable the servers 2402 and 2404 to communicate with the clients 2406 and 2408 via the communication network 2410. The communication network 2410 may include, but is not limited to, the Internet, an intranet, a LAN (Local Area Network), a WAN (Wide Area Network), a MAN (Metropolitan Area Network), a wireless network, an optical network, and the like. The communication facilities provided by the communication network 2410 are capable of supporting distributed implementations of exemplary embodiments.

In an exemplary embodiment, the servers 2402 and 2404 may provide the clients 2406 and 2408 with computer-readable and/or computer-executable instructions, components or products under a particular condition, such as a license agreement. The computer-readable and/or computer-executable instructions, components or products may include those for providing and implementing exemplary embodiments. In an exemplary embodiment, the servers 2402 and 2404 may transmit computer-readable and/or computer-executable instructions, components or products for selecting and controlling sub-pixels of the display using the computer-readable and/or computer-executable instructions, components and products provided by the servers 2402 and 2404. In an exemplary embodiment, the clients 2406 and 2408 may transmit sub-pixel selection and control results of the processing by the clients to the servers 2402 and 2404.

Alternatively, in another exemplary embodiment, the clients 2406 and 2408 may transmit computer-readable and/or computer-executable instructions, components or products for performing sub-pixel selection and control to the servers 2402 and 2404 which may, in turn, transmit sub-pixel selection and control signals using the computer-readable and/or computer-executable instructions, components and products provided by the clients 2406 and 2408. In an exemplary embodiment, the servers 2402 and 2404 may transmit sub-pixel selection and control signals to the clients 2406 and 2408.

Exemplary methods may be implemented and executed on one or more embedded computing devices. FIG. 25 is a block diagram of an exemplary embedded computing or processing device 2500 that may be used to perform any of the methods or implement any of the systems and devices provided by exemplary embodiments. For example, the computer device

2500 may be used to selectively and cooperatively address a first set of sub-pixels on a first display screen and a second set of sub-pixels on a second display screen. The embedded computing device 2500 may be any suitable device incorporating electronics to control operational functions, and in which computing and networking capabilities are embedded. For example, devices in which the computing and networking capabilities may be embedded may include, but are not limited to, audio-video equipment (e.g., audio and video recorders and players, televisions, digital cameras, digital video cameras, compact disks, digital video disks, camcorders, and the like), communication devices (e.g., telephones, cell phones, audio and video conferencing systems, the iPhone™ communication device, the iPad™ communication device, and the like), entertainment devices (e.g., set-top boxes, game consoles, and the like), and the like.

The embedded computing device 2500 may include memory 2502 that includes one or more non-transitory computer-readable media for storing one or more computer-executable instructions or software for implementing exemplary embodiments. The non-transitory computer-readable media may include, but are not limited to, one or more types of hardware memory, non-transitory tangible media, and the like. Memory 2502 may include a computer system memory or random access memory, such as DRAM, SRAM, EDO RAM, and the like. Memory 2502 may include other types of memory as well, or combinations thereof. Memory 2502 may include a pixel addressing module 2512 for storing data and computer-readable instructions that implement and perform methods associated with addressing a first set of sub-pixels on a first display screen (e.g., by driving electrodes on the first display screen) and a second set of sub-pixels on a second display screen (e.g., by driving electrodes on the second display screen), such that the first set of sub-pixels addressed is spatially offset from the second set of sub-pixels addressed in a vertical direction and/or a horizontal direction along the planes formed by the surfaces of the first and second display screens.

The embedded computing device 2500 may include operational circuitry 2504 that operate device functions. The embedded computing device 2500 may include one or more processing units 2506 to provide embedded computing capabilities, for example, for addressing sub-pixels in a display screen. The processing unit 2506 may execute computer-executable instructions or software for implementing exemplary embodiments, and one or more other programs for controlling system hardware. The processing unit 2506 may have hardware interfaces to the operational circuitry 2504 that operate device functions. The processing unit 2506 may be one or more microprocessors or one or more micro-controllers.

The embedded computing device 2500 may include one or more network adapters 2508 for connecting with a network media 2510 that is interconnected with a computer network. The network adapter 2508 may be a network interface card suitable to the particular network media 2510. For example, exemplary network adapters 2508 may include, but are not limited to, a built-in network adapter, network interface card, PCMCIA network card, card bus network adapter, wireless network adapter, USB network adapter, modem or any other device. The network media 2510 may be any type of wired or wireless network media including, but not limited to, Ethernet, firewire, radio frequency, television cable, Local Area Network (LAN), Wide Area Network (WAN) or the Internet through a variety of connections including, but not limited to, standard telephone lines, LAN or WAN links (for example, 802.26, T1, T3, 56 kb, X.25), broadband connections (for example, ISDN, Frame Relay, ATM), wireless connections, controller area network (CAN), or some combination of any or all of the above.

The entire contents of all references, including patents, patent applications and non-patent publications, cited throughout this application are hereby incorporated herein by reference in their entirety. The appropriate components and methods of those references may be selected for the invention and embodiments thereof. Still further, the components and methods identified in the Background section are integral to this disclosure and may be used in conjunction with or substituted for components and methods described elsewhere in the disclosure within the scope of the invention.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of system elements or method steps, those elements or steps may be replaced with a single element or step. Likewise, a single element or step may be replaced with a plurality of elements or steps that serve the same purpose. Further, where parameters for various properties are specified herein for exemplary embodiments, those parameters may be adjusted up or down by 1/20th, 1/10th, 1/5th, 1/3rd, 1/2nd, and the like, or by rounded-off approximations thereof, unless otherwise specified. Moreover, while exemplary embodiments have been shown and described with references to particular embodiments thereof, those of ordinary skill in the art will understand that various substitutions and alterations in form and details may be made therein without departing from the scope of the invention. Further still, other aspects, functions and advantages are also within the scope of the invention.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than shown.

What is claimed is:

1. A method of fabricating an image display assembly for providing enhanced color resolution, the method comprising:

assembling a first display screen having a first color resolution and comprising a first set of addressable sub-pixels in an overlaid manner with a second display screen having a second color resolution and comprising a second set of addressable sub-pixels;

aligning a first set of color filter elements associated with the first set of sub-pixels of the first display screen, wherein each of the first set of color filter elements is aligned with one of the first set of sub-pixels and filters optical output from the one of the first set of sub-pixels;

aligning a second set of color filter elements associated with the second set of sub-pixels of the second display screen, wherein each of the second set of color filter elements is aligned with one of the second set of sub-pixels and filters optical output from the one of the second set of sub-pixels; and providing a processing device configurable to:

address the first set of sub-pixels of the first display screen to generate filtered optical output from the first set of sub-pixels through the first set of color filter elements, and address the second set of sub-pixels of the second display screen to generate filtered optical output from the second set of sub-pixels through the second set of color filter elements;

wherein the first set of sub-pixels addressed is spatially offset from the second set of sub-pixels addressed in a vertical direction or a horizontal direction along planar image display surfaces of the first and second display screens such that the first set of sub-pixels addressed do not overlap with the second set of sub-pixels addressed; and wherein the cooperative addressing of the first and second sets of sub-pixels displays an image pixel with a color resolution greater than the first color resolution provided by the first display screen and the second color resolution provided by the second display screen.

2. The method of claim 1, wherein the first display screen and the second display screen are fabricated as separate components before assembly.

3. The method of claim 1, wherein the first and second display screens employ liquid crystal device (LCD) technology.

4. An image display assembly for providing enhanced color resolution, the image display assembly comprising:

a first display screen comprising a first set of addressable sub-pixels, the first display screen having a first color resolution;

a second display screen comprising a second set of addressable sub-pixels assembled with the first display screen in an overlaid manner, the second display screen having a second color resolution;

a first set of color filter elements associated with the first set of addressable sub-pixels of the first display screen, wherein each of the first set of color filter elements is aligned with one of the first set of sub-pixels and filters optical output from the one of the first set of sub-pixels;

a second set of color filter elements associated with the second set of addressable sub-pixels of the second display screen, wherein each of the second set of color filter elements is aligned with one of the second set of sub-pixels and filters optical output from the one of the second set of sub-pixels; and a processing device configurable to:

address the first set of sub-pixels of the first display screen to generate filtered optical output from the first set of sub-pixels through the first set of color filter elements, and address the second set of sub-pixels of the second display screen to generate filtered optical output from the second set of sub-pixels through the second set of color filter elements;

wherein the first set of sub-pixels addressed is spatially offset from the second set of sub-pixels addressed in a vertical direction or a horizontal direction along planar image display surfaces of the first and second display screens such that the first set of sub-pixels addressed do not overlap with the second set of sub-pixels addressed; and wherein the cooperative addressing of the first and second sets of sub-pixels displays an image pixel with a color resolution greater than the first color resolution provided by the first display screen and the second color resolution provided by the second display screen.

5. The image display assembly of claim 4, wherein the greater color resolution enables image display in an enhanced color space formed using at least four primary colors.

6. The image display assembly of claim 4, wherein the first set of sub-pixels addressed is horizontally offset from the second set of sub-pixels addressed by a fraction of a pixel width along the planar image display surfaces of the first and second display screens.

7. The image display assembly of claim 4, wherein the first set of sub-pixels addressed is vertically offset from the second set of sub-pixels addressed by a fraction of a pixel height along the planar image display surfaces of the first and second display screens.

8. The image display assembly of claim 4, wherein the first set of sub-pixels addressed is horizontally offset from the second set of sub-pixels addressed by a fraction of a pixel width along the planar image display surfaces of the first and second display screens, and vertically offset from the second set of sub-pixels addressed by a fraction of a pixel height along the planar image display surfaces of the first and second display screens.

9. The image display assembly of claim 4, wherein a first color filter element among the first and second sets of color filter elements transmits a first color at a first intensity, and a second color filter element among the first and second sets of color filter elements transmits the first color at a second, different intensity.

* * * * *